US006545224B2

(12) United States Patent
Sawada et al.

(10) Patent No.: US 6,545,224 B2
(45) Date of Patent: Apr. 8, 2003

(54) PLATE-LIKE INSULATING MEMBER AND METHOD OF FIXING ELECTRIC WIRE TO PLATE-LIKE INSULATING MEMBER

(75) Inventors: Yoshitsugu Sawada, Shizuoka (JP); Hiroyuki Suzuki, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/981,387

(22) Filed: Oct. 18, 2001

(65) Prior Publication Data

US 2002/0043394 A1 Apr. 18, 2002

(30) Foreign Application Priority Data

Oct. 18, 2000 (JP) ..... 2000-317980
Oct. 20, 2000 (JP) ..... 2000-320908

(51) Int. Cl.[7] ..... H01B 17/00

(52) U.S. Cl. ..... 174/149 R; 174/138 G; 174/138 F; 439/342

(58) Field of Search ..... 174/149 R, 138 F, 174/138 G, 148, 167, 176, 177; 439/342, 884

(56) References Cited

U.S. PATENT DOCUMENTS 6,099,359 A * 8/2000 Yamamuro ..... 439/736
6,450,844 B1 * 9/2002 Mizumura et al. ..... 439/884

* cited by examiner

*Primary Examiner*—Dean A. Reichard
*Assistant Examiner*—W. David Walkenhorst
(74) *Attorney, Agent, or Firm*—Sughrue Mion, PLLC

(57) ABSTRACT

A wire fixing portion (70) prevents an electric wire (4) from withdrawing from a wire receiving groove (61). The wire fixing portion (70) includes retaining pawls (71), an engagement member (72), etc. The retaining pawl (71) is elastically deformable between a restriction position in which the retaining pawl (71) retains the electric wire (4) to thereby restrict the electric wire from withdrawing from the wire receiving groove (61), and an allowable position in which the electric wire is allowed to withdraw from the wire receiving groove (61). The engagement member (72) engages with the retaining pawls (71) to thereby hold the retaining pawls (71) at the restriction position. When the engagement member engages between the retaining pawls (71), a gap (81) between the pair of the retaining pawls (71) extended upward from the both edges of the wire receiving groove (61) becomes narrower.

20 Claims, 19 Drawing Sheets

PLATE-LIKE INSULATING MEMBER AND METHOD OF FIXING ELECTRIC WIRE TO PLATE-LIKE INSULATING MEMBER

BACKGROUND OF THE INVENTION

1. Field of the Invention

The present invention relates to a plate-like insulating member to which press-connecting terminals are attachable, and a plurality of the plate-like insulating members can be stacked together.

The present application is based on Japanese Patent Applications Nos. 2000-317980 and 2000-320908, which are incorporated herein by reference.

2. Description of the Related Art

A wire harness mounted on a vehicle, such as an automobile etc., is configured in a manner that a plurality of sub-harnesses respectively divided in accordance with functions etc. of an electric device are once configured, and these sub-harnesses are assembled from one another as a single wire harness. Thus, the connection operation of the electric wires among the sub-harnesses is troublesome and so the workability at the time of assembling the sub-harnesses tends to be degraded. If worst comes to worst, the quality of the wire harness may not be stable.

FIGS. 22 and 23 show a plate-like insulating member 160, to which a press-connecting terminal is attached, and which can facilitate the connection operation of the electric wires. A plurality of the plate-like insulating members 160 are stacked together to form a plate connector.

The plate-like insulating member 160 shown in FIGS. 22 and 23 is made of synthetic resin. As shown as an example in FIGS. 22 and 23, the plate-like insulating member 160 includes a flat-shaped bottom wall 161, a plurality of separation walls 162 extended upward from the bottom wall 161, a plurality of wire receiving grooves 163, and wire fixing portions 164.

The plurality of the separation walls 162 are disposed so as to be in parallel and spaced with a constant distance from one another. The wire receiving groove 163 is formed so as to be surrounded by the adjacent separation walls 162 and the bottom wall 161. The wire receiving grooves 163 are disposed in parallel from one another along the direction in which the separation walls 162 are disposed in parallel. The wire receiving groove 163 receives at least a wire connection portion of the press-connecting terminal and an electric wire 165 press-connected to the wire connection portion.

Each of the wire fixing portions 164 includes retaining pawls 166 and a locking portion 167 provided in correspondence with the associated one of the wire receiving grooves 163. The retaining pawls 166 are provided at the end portions of the wire receiving grooves 163 so as to be able to retain the electric wire 165, respectively. Each of the locking portions 167 is coupled to the bottom wall 161 through a self hinge 168 and able to be engaged between the retaining pawls 166 and the separation wall 162.

In the wire fixing portion 164, the locking portion 167 is displaced from a state shown in FIG. 22 toward a portion between the retaining pawls 166 and the separation wall 162 against the elastic restoring force of the self hinge 168. Thus, as shown in FIG. 23, the locking portion 167 engages between the retaining pawls 166 and the separation wall 162. Then, the wire fixing portion 164 keeps the retaining pawls 166 in a state retaining the electric wire 165 to thereby prevent the electric wire 165 from withdrawing from the wire receiving groove 163.

The press-connecting terminal is formed by bending a sheet metal. The press-connecting terminal includes the wire connection portion to be connected to the electric wire 165 and a cylindrical electric contact portion continuing to the wire connection portion. The wire connection portion includes a pair of press-connecting blades, which oppose to each other, and to which the electric wire 165 is press-connected. A belt-shaped connection bar with electric conductivity is inserted into the electric contact portion. The press-connecting terminal is disposed in a manner that the wire connection portion and the electric contact portion are configured in an L-shape in their plan view. The press-connecting terminal is disposed on the bottom wall 161 of the plate-like insulating member 160.

The plate-like insulating member 160 is arranged in a manner that the press-connecting terminals are disposed on the bottom wall 161 along the longitudinal direction of the wire receiving grooves 163 and the direction in which the wire receiving grooves 163 are disposed in parallel. That is, the plate-like insulating member 160 is arranged in a manner that the press-connecting terminals are disposed on the bottom wall 161 in a two-dimensional matrix shape. A plurality of the plate-like insulating members 160 in each of which the press-connecting terminals are disposed in the two-dimensional matrix shape are stacked, and the connection bars are inserted into the desired electric contact portions of the stacked electric contact portions to obtain the plate connector.

In this manner, in the plate connector, the press-connecting terminals, to which the electric wires 165 are respectively press-connected, are disposed at the desired positions of the bottom wall 161 of the plate-like insulating member 160 and the connection bars are inserted into the desired electric contact portions to thereby mutually connect the electric wires 165 in accordance with a predetermined pattern.

However, since the wire fixing portion 164 of the plate-like insulating member 160 is arranged in a manner that the locking portion 167 is coupled to the bottom wall 161 through the self hinge 168, the locking portion protrude outward from the bottom wall 161. Thus, the locking portion 167 may be caught on a worker or a working machine during the operation of assembling the plate connector. If worst comes to worst, the self hinge 168 may be broken and the locking portion 167 may be separated from the bottom wall 161.

Further, the locking portion 167 is rotated around the self hinge 168 and engaged between the retaining pawls 166 and the separation wall 162. Thus, at the time of engaging the locking portion between the retaining pawls 166 and the separation wall 162, it is necessary to rotate the locking portion 167 so as to aim the portion therebetween, so that a time required for the fixing operation of the each electric wire 165 tends to increase. Therefore, the time required for the fixing operation of the electric wires 165 becomes longer and so a time required for assembling the plate connector tends to increase.

Furthermore, in the wire fixing portion of the plate-like insulating member 160, a gap appears between the retaining pawls 166. If a relatively thin electric wire is inserted into the wire receiving groove 163, the electric wire may withdraw from a portion between the retaining pawls 166. In this manner, it is considered that a relatively thin electric wire can not be fixed surely when using the plate-like insulating member 160.

SUMMARY OF THE INVENTION

Accordingly, an object of the present invention is to provide a plate-like insulating member and a method of fixing electric wires to the plate-like insulating member, which can prevent the breakage of the plate-like insulating member during the assembling operation thereof, and can easily and surely fix electric wires press-connected to press-connecting terminals even if the electric wires are relatively thin.

To achieve the above object, according to a first aspect of the present invention, there is provided a plate-like insulating member, comprising:

a plurality of wire receiving grooves, in which electric wires are respectively receivable, juxtaposed to each other, the electric wires being respectively connectable to a plurality of press-connecting terminals; and a plurality of wire fixing portions which prevent the electric wires, received in the wire receiving grooves, from withdrawing from the wire receiving grooves, wherein the plurality of wire fixing portions include:

retaining pawls comprising:

pawl bodies which are disposed correspondingly to the wire receiving grooves to retain the electric wires in the respective wire receiving grooves, wherein each of the pawl bodies can displace between a restriction position in which the electric wire is prevented from withdrawing from the wire receiving groove, and an allowable position in which the electric wire is allowed to withdraw from the wire receiving groove, and engagement projections which are protruded from the pawl bodies in a direction in which the pawl bodies respectively disposed in the adjacent wire receiving grooves approach to each other, and at least one engagement member insertable between the pawl bodies disposed in the adjacent wire receiving grooves, the at least one engagement member being engaged with the engagement projections of the pawl bodies, thereby restricting displacement of the pawl bodies from the restriction position toward the allowable position.

Accordingly, the electric wire is inserted between the pawl bodies with pressure, so that the electric wire is received within the corresponding wire receiving groove. Further, when the engagement member is engaged with the engagement projections of the retaining pawls, the pawl bodies are restricted from displacing to the allowable position from the restriction position to thereby hold the pawl bodies at the restriction position. Thus, the electric wire can surely be fixed within the wire receiving groove. Further, the engagement member is provided between the pawl bodies disposed between the adjacent wire receiving grooves. Therefore, the engagement member does not protrude outwardly from the plate-like insulating member. Accordingly, at the time of assembling the plate connector by, for example, stacking the plate-like insulating members at each of which the press-connecting terminals are attached, the engagement member can be prevented from contacting to a worker, an assembling apparatus, etc.

The plurality of press-connecting terminals include wire connection portions, to which the electric wires are respectively connected, and electrical contact portions respectively extending from the wire connection portions.

According to a second aspect of the present invention, it is preferable that each of the pawl bodies is elastically deformable between the restriction position and the allowable position, and is positioned at the restriction position in an initial state, and the at least one engagement member is elastically deformable and engages with the engagement projections against an elastic restoring force. Accordingly, the electric wire inserted with pressure between the pawl bodies can be prevented from suddenly withdrawing from the corresponding wire receiving groove. Further, the engagement member is deformed against the elastic restoring force and engaged with the engagement projections. Thus, in the initial state, the engagement member is placed in a state not engaging with the engagement projections. Therefore, the engagement member scarcely engages with the engagement projections before inserting the electric wire with pressure between the pawl bodies. Thus, the wire fixing portion does not interfere the operation of inserting the electric wire within the corresponding wire receiving groove.

According to a third aspect of the present invention, it is preferable that the plate-like insulating member further comprises a plate body made of insulative synthetic resin, the plate body being integrally formed with the retaining pawls and the at least one engagement member, wherein the retaining pawls are respectively provided at end portions of the wire receiving grooves. Accordingly, increase of the number of the parts of the plate-like insulating member can be suppressed. Further, since the plate body is formed integrally with the retaining pawls and the engagement members, the retaining pawls and the engagement members can surely be elastically deformed. Furthermore, since the retaining pawl is provided at the end portion of the wire receiving groove, enlargement of the plate body, that is, the plate-like insulating member can be suppressed.

According to a fourth aspect of the present invention, it is preferable that the at least one engagement member is integrally formed at one end portion thereof with the plate body and can engage with the engagement projections of the pawl bodies at the other end portion of the at least one engagement member, and wherein the plate-like insulating member further comprises a deformation preventing projection protruding from the plate body and having a restriction surface which opposes to the other end portion of the at least one engagement member engaging with the engagement projections. Thus, the deformation preventing projection is provided with the restriction surface which protrudes from the plate-like insulating member and opposes to the end surface of the engagement member engaging with the engagement projections. Even if the engagement member is forced to further deform against the elastic restoring force after it engages with the engagement projections, the end surface contacts to the restriction surface. The restriction surface serves to prevent the engagement member from being deformed excessively. Therefore, the engagement member is prevented from causing such a phenomenon that the engagement member is excessively deformed exceeding the elastic limit and the one end portion is broken and the engagement member is separated from the plate body.

According to a fifth aspect of the present invention, it is preferable that the other end portion of the at least one engagement member engaging with the engagement projections is restricted from separating from the restriction surface of the deformation preventing projection. Thus, even if the one end portion of the engagement member is broken and the engagement member is separated from the plate body, the engagement member continues to engage with the engagement projections since the other end portion of the engagement member does not separate from the restriction surface.

According to a sixth aspect of the present invention, it is preferable that the plate-like insulating member further comprises a withdrawal prevention wall extending upward from an end portion of the plate body, the withdrawal prevention wall being provided between the pawl bodies disposed in the adjacent wire receiving grooves, wherein the other end portion of the at least one engagement member engaging with the engagement projections can displace in a direction approaching to the withdrawal prevention wall along the restriction surface of the deformation preventing projection. Thus, the withdrawal prevention wall is provided between the pawl bodies disposed in the adjacent wire receiving grooves and is extended upward from the end portion of the plate body. Therefore, when the one end portion of the engagement member is broken and the engagement member is separated from the plate body, the engagement member contacts to the withdrawal prevention wall even if the engagement member is forced to displace along the restriction surface.

According to a seventh aspect of the present invention, it is preferable that the plate-like insulating member further comprises a convex-shaped curved surface formed at the other end portion of the at least one engagement member in a direction away from the plate body; and an outer wall extending upward from the end portion of the plate body, wherein the at least one engagement member is disposed between the outer wall and the withdrawal prevention wall. Accordingly, when a jig such as a wedge-shaped jig is inserted from the tip end thereof between the engagement member and the outer wall, the engagement member is elastically deformed gradually by the curved surface in a direction of engaging with the engagement projections.

According to an eighth aspect of the present invention, there is provided a method of fixing an electric wire to a plate-like insulating member, comprising the steps of:

providing a plate-like insulating member which comprises:

a plate body made of insulative synthetic resin;

a plurality of wire receiving grooves, in which electric wires are respectively receivable, juxtaposed to each other, the electric wires being respectively connectable to a plurality of press-connecting terminals;

a plurality of wire fixing portions which prevent the electric wires, received in the wire receiving grooves, from withdrawing from the wire receiving grooves, wherein the plurality of wire fixing portions include:

retaining pawls integrally formed with the plate body at end portions of the wire receiving grooves, the retaining pawls comprising:

pawl bodies which are disposed correspondingly to the wire receiving grooves to retain the electric wires in the respective wire receiving grooves, wherein each of the pawl bodies can displace between a restriction position in which the electric wire is prevented from withdrawing from the wire receiving groove, and an allowable position in which the electric wire is allowed to withdraw from the wire receiving groove, and engagement projections which are protruded from the pawl bodies in a direction in which the pawl bodies respectively disposed in the adjacent wire receiving grooves approach to each other, and at least one engagement member insertable between the pawl bodies disposed in the adjacent wire receiving grooves, the at least one engagement member being integrally formed with the plate body, the at least one engagement member being engaged with the engagement projections of the pawl bodies, thereby restricting displacement of the pawl bodies from the restriction position toward the allowable position; and an outer wall extending upward from an end portion of the plate body;

receiving an electric wire in one of the wire receiving grooves;

gradually inserting a pressing jig from a tip end thereof between the pawl bodies disposed at the adjacent wire receiving grooves and also between the engagement member and the outer wall, wherein thickness of the pressing jig becomes thinner toward the plate body; and engaging the engagement member with the engagement projections.

In accordance with the eighth aspect of the present invention, the pressing jig is inserted from the tip end thereof into the portion which is between the pawl bodies disposed at the adjacent wire receiving grooves and also between the engagement member and the outer wall. Thus, the engagement member is elastically deformed gradually by the curved surface etc. in the direction of engaging with the engagement projections and engages with the engagement projections.

According to a ninth aspect of the present invention, it is preferable that the plate body has through holes each provided at a portion which is between the pawl bodies disposed at the adjacent wire receiving grooves and also between the engagement member and the outer wall, and wherein, in the step of gradually inserting the pressing jig, a pushing jig having a pushing surface along one end portion of the engagement member is inserted through the through hole from a reverse side of the pushing jig from the pressing surface into the portion which is between the pawl bodies and also between the at least one engagement member and the outer wall. Accordingly, the pushing jig is inserted through the through hole into the portion which is between the pawl bodies disposed at the adjacent wire receiving grooves and also between the engagement member and the outer wall. Then, the pushing surface of the pushing jig contacts to the one end portion of the engagement member.

Thus, at the time of engaging the engagement member with the engagement projections by using the pressing jig, the pushing surface supports the one end portion of the engagement member. Therefore, eve if the other end portion and the engagement projections are forced to shift to each other due to the elastic restoring force of the engagement member etc., the other end portion can surely engage with the engagement projections since the one end portion is supported.

According to a tenth aspect of the present invention, there is provided a plate-like insulating member which comprises:

a plurality of wire receiving grooves, in which electric wires are respectively receivable, juxtaposed to each other, each of the wire receiving grooves having a distance along a width direction thereof, the electric wires being respectively connectable to a plurality of press-connecting terminals; and a plurality of wire fixing portions which prevent the electric wires, received in the wire receiving grooves, from withdrawing from the wire receiving grooves, wherein the plurality of wire fixing portions include:

pairs of retaining pawls extended upward from respective opposite edges of the wire receiving grooves in the width directions thereof to retain the electric wires in the wire receiving grooves, wherein each of the retaining pawls can displace between a restriction position in which the electric wire is prevented from withdrawing from the wire receiving groove, and an allowable position in which the electric wire is allowed to withdraw from the wire receiving groove, and at least one engagement member insertable between the retaining pawls disposed in the adjacent wire receiving grooves to engage with the retaining pawls, thereby restricting displacement of the pawl bodies toward the allowable position and causing a distance between the pair of retaining pawls extended upward from the opposite edges of the wire receiving groove to become smaller than a distance between the pair of retaining pawls at the restriction position. Accordingly, when the engagement member engages between the retaining pawls extended upward from the adjacent wire receiving grooves, the distance between the pair of retaining pawls extended upward from the both edges of the wire receiving groove becomes smaller than the distance at the restriction position.

According to an eleventh aspect of the present invention, it is preferable that a width of the at least one engagement member along the width direction of the wire receiving groove is greater than a distance between the retaining pawls extended upward from the edges of the adjacent wire receiving grooves at the restriction position. Accordingly, when the engagement member engages between the retaining pawls, the gap between the pair of the retaining pawls extended upward from the both edges of the wire receiving groove more surely becomes narrower.

According to a twelfth aspect of the present invention, it is preferable that, when the at least one engagement member is engaged between the retaining pawls, the pair of retaining pawls extended upward from the opposite edges of the wire receiving groove are brought into contact with each other. Thus, there appears no gap between the pair of the retaining pawls.

BRIEF DESCRIPTION OF THE DRAWINGS

The above and other objects and advantages of the present invention will become more apparent by describing in detail preferred embodiments thereof with reference to the accompanying drawings, wherein.

DETAILED DESCRIPTION OF THE PREFERRED EMBODIMENTS

Figure 2:
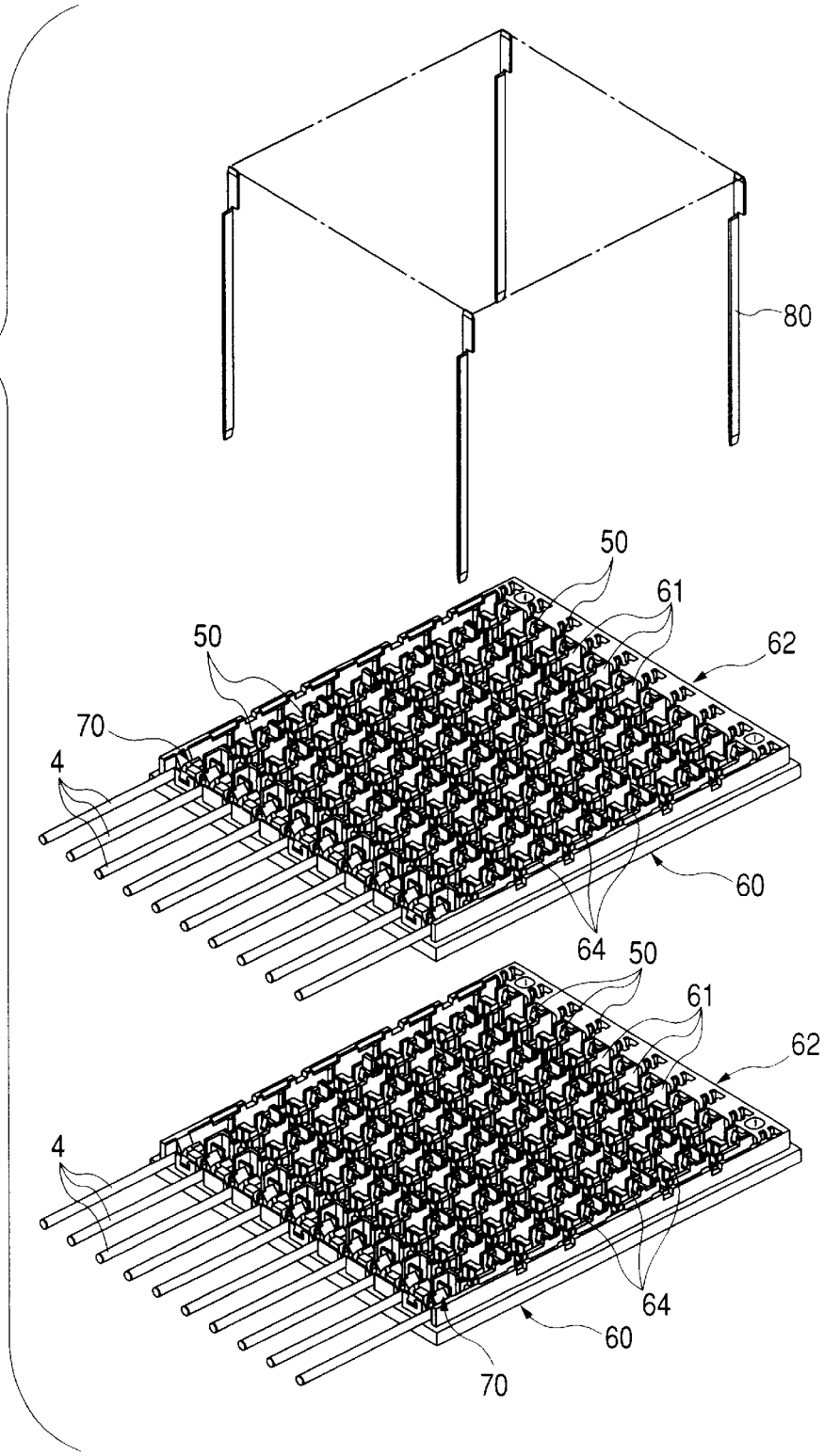
FIG. 2 is a perspective view showing a state in which the press-connecting plates shown in FIG. 1 are stacked while having a space therebetween.
Figure 3:
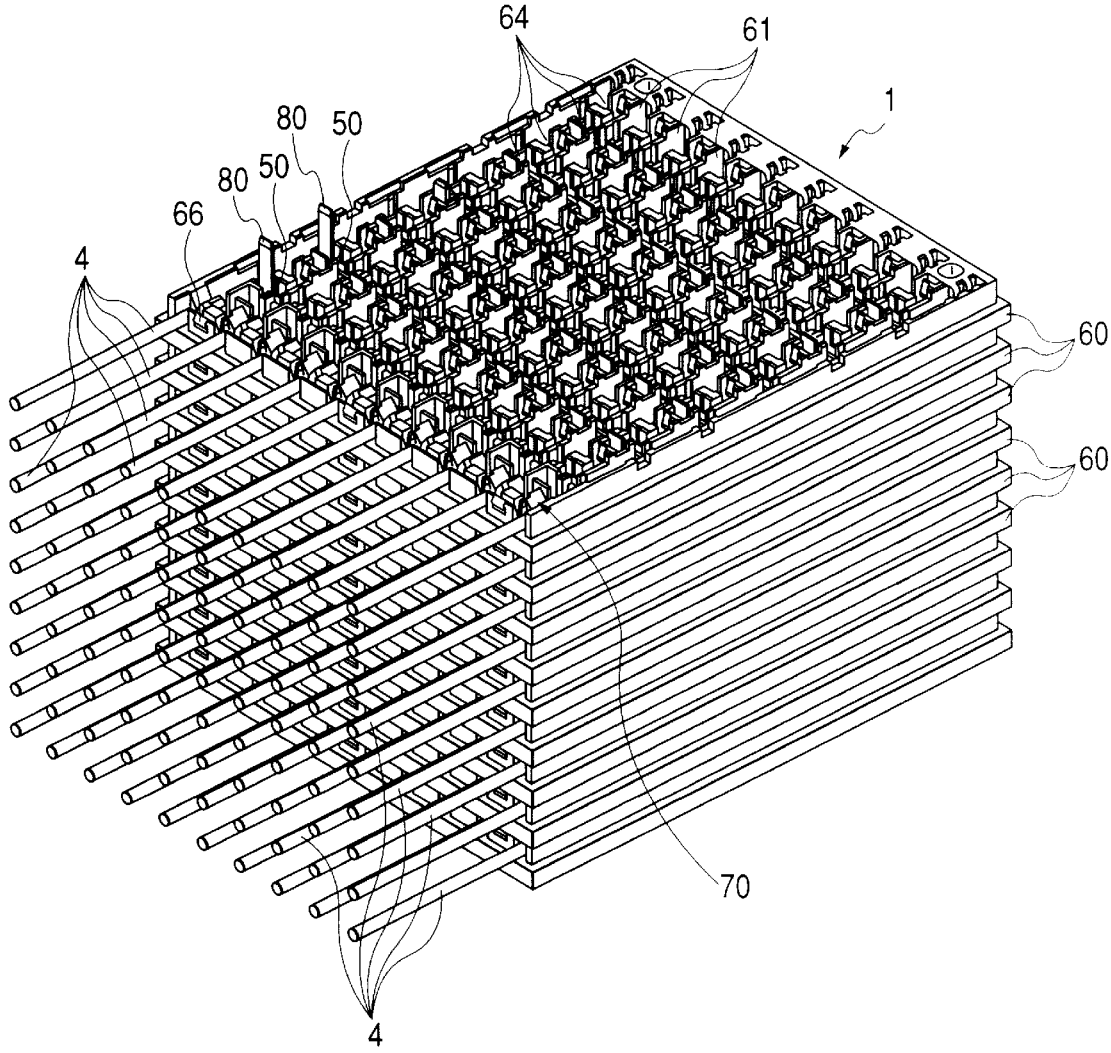
FIG. 3 is a perspective view showing a stacked plate connector obtained by fixing the press-connecting plates shown in FIG. 1 to each other.
Figure 4:
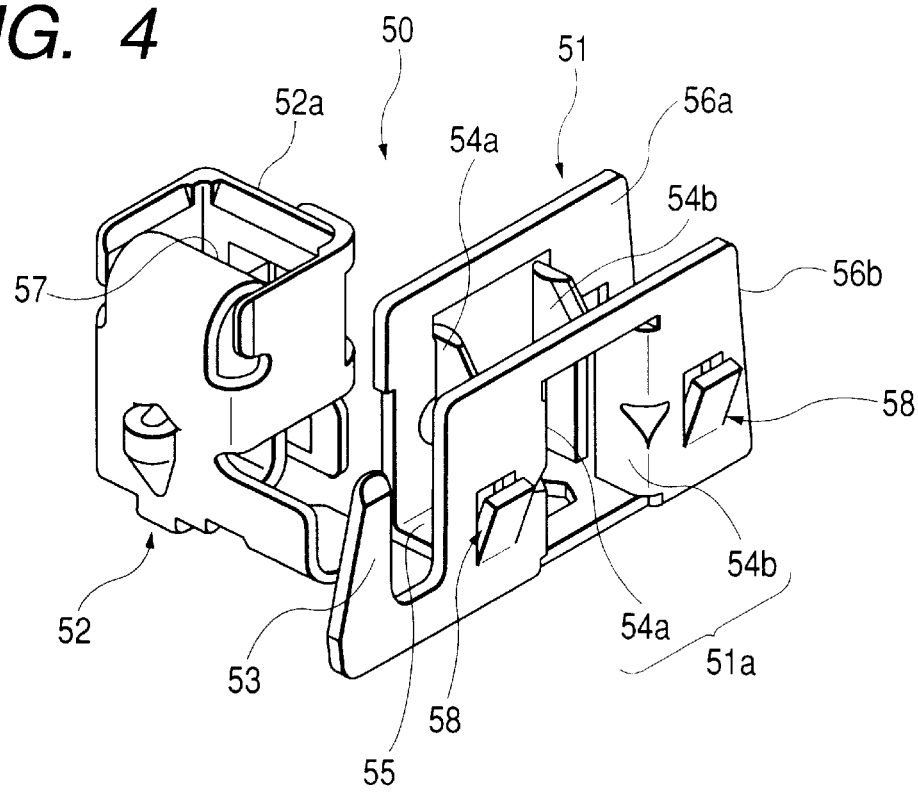
FIG. 4 is a perspective view showing the JB (i.e., junction block) press-connecting terminal of the stacked plate connector shown in FIG. 3.
Figure 5:
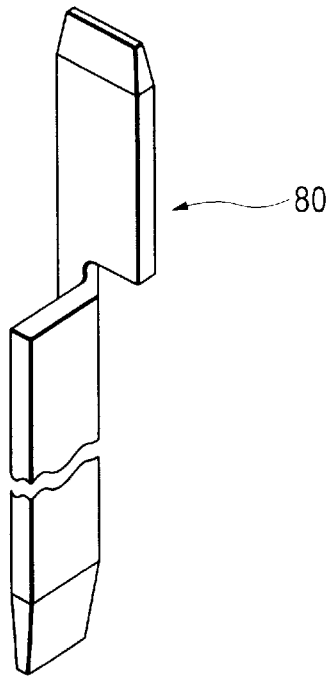
FIG. 5 is a perspective view showing a connection bar of the stacked plate connector shown in FIG. 3.

A press-connecting plate 60, serving as a plate-like insulating member, according to a first embodiment of the present invention now will be described with reference to FIGS. 1 to 21C. A JB (i.e., junction block) press-connecting terminals 50 serving as press-connecting terminals as shown in FIG. 4 are attached to the press-connecting plate 60 serving as the plate like insulating member according to the first embodiment of the present invention shown in FIG. 1, and a plurality of such press-connecting plates are stacked as shown in FIG. 2 to thereby configure a stacked plate connector 1 serving as a plate connector shown in FIG. 3.

Figure 1:
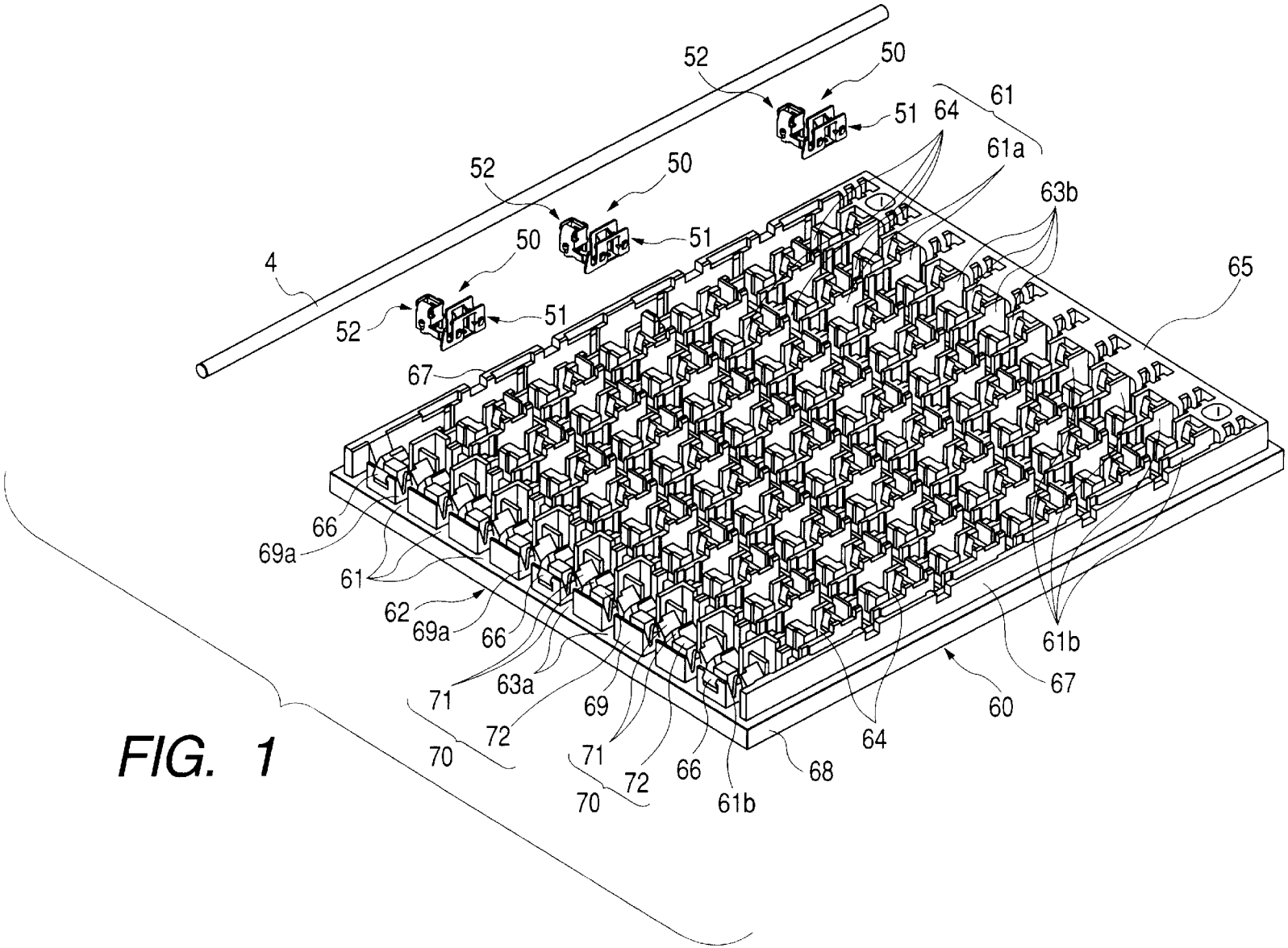
FIG. 1 is a perspective view showing a press-connecting plate etc. according to a first embodiment of the present invention.

The electric wire 4 (as shown in FIG. 1 etc.) is press-connected to the JB press-connecting terminal 50. The stacked plate connector 1 electrically connects the electric wires 4, press-connected to the JB press-connecting terminals 50, in accordance with a predetermined pattern.

The JB press-connecting terminal 50 is formed by bending a conductive sheet metal, for example. As shown in FIG. 4, the JB press-connecting terminal 50 includes a wire connection portion 51, an electrical contact portion 52 and a plurality of stop pieces 58. The wire connection portion 51 includes a flat placing wall 55 on which the electric wire 4 is placed, a pair of side walls 56*a*, 56*b* and a clamping piece portion 53 and a press-connecting portion 51*a*.

The placing wall 55 is formed in a belt-plate shape. The pair of the side walls 56*a*, 56*b* are provided so as to continue along the both edges of the placing wall 55 which are disposed with a space therebetween along the width direction of the placing wall 55. The pair of the side walls 56*a*, 56*b* are provided so as to extend upward from the placing wall 55. The pair of the side walls 56*a*, 56*b* position therebetween the electric wire 4 which is press-connected to the press-connecting portion 51*a*.

The clamping piece portion 53 is extended upward from the placing wall 55. The clamping piece portion 53 is continuous to the edge of the placing wall 55 extending in the width direction there of. The clamping piece portion 53 is bent so as to cover the placing wall 55 to thereby sandwich and hold the electric wire 4 between the placing wall 55 and the clamping piece. That is, the clamping piece portion 53 clamps the electric wire 4 against the placing wall 55.

The press-connecting portion 51*a* is provided with two pairs of press-connecting blades 54*a*, 54*b* opposing to each other. The press-connecting blades 54*a*, 54*b* extend upward from the placing wall 55. The two pairs of press-connecting blades 54*a*, 54*b* protrude from the inner surfaces of the side walls 56*a*, 56*b* toward the pair of the side walls 56*a*, 56*b* so as to approach to each other.

The electric wire 4 is pushed into the press-connecting blades 54*a*, 54*b*, whereby the press-connecting blades cut into the covering portions 5 (shown in FIG. 15) of the electric wire 4 and are made contact with a core wire 6 (shown in FIG. 15) to thereby electrically couple to the electric wire 4. That is, the electric wire 4 is press-connected to the press-connecting blades 54*a*, 54*b*.

The electrical contact portion 52 is continuous to one of the edges of the placing wall 55 extending in the width direction thereof. That is, the electrical contact portion 52 is continuous to the wire connection portion 51. The electrical contact portion 52 and the wire connection portion 51 are disposed at such positions that the JB press-connecting terminal 50 is configured in an L-shape in its plan view. The electrical contact portion 52 is disposed at a position where the electric wire 4 placed on the placing wall 55 is bent from its longitudinal direction with respect to the wire connection portion 51.

The electrical contact portion 52 is formed in a square cylindrical shape. The electrical contact portion 52 is disposed in a manner that the cylindrical hole thereof is continuous to the not-shown hole of the press-connecting plate 60. A connection bar 80 shown in FIG. 5 etc. as an insertion element is inserted into the cylindrical hole of the electrical contact portion 52. The connection bar 80 is made of conductive metal etc. and configured in a belt-plate shape. A connection spring piece 57 is provided within the cylindrical hole of the electrical contact portion 52. The connection spring piece 57 presses the connection bar 80 toward the inner surface of the cylindrical hole of the electrical contact portion 52. The connection spring piece 57 electrically connects the connection bar 80 to the electrical contact portion 52.

When the press-connecting plates 60 are stacked from one another, the electrical contact portion 52 serves to electrically connect the stacked JB press-connecting terminals 50 from one another by inserting the connection bar 80 within the cylindrical hole. In this manner, the electrical contact portion 52 is coupled to another JB press-connecting terminal as another terminal metal member.

The stop pieces 58 are formed by cutting parts of the side walls 56*a*, 56*b*. The stop pieces 58 are provided at each of the side walls 56*a*, 56*b*. The stop pieces 58 are continuous at their one end portions to the side walls 56*a*, 56*b* and separated at their other end portions from the side walls 56*a*, 56*b*. In the respective stop pieces 58, particularly, the other end portions protrude outward from the outer surfaces of the side walls 56*a*, 56*b*.

As shown in FIG. 4 etc., the stop pieces 58 are slanted so as to separate gradually from the outer surfaces of the side walls 56*a*, 56*b* toward the other end portions from the one end portions. The other end portion of the stop piece 58 can engage with the inner surface of a separation wall 63*b* described later when the JB press-connecting terminal 50 is attached to the press-connecting plate 60.

In the JB press-connecting terminal 50, the wire connection portion 51 is received within the groove body 61*a* of a wire receiving groove 61 described later of the press-connecting plate 60 and the electrical contact portion 52 is received within the receiving portion 64 described later of the wire receiving groove 61. The JB press-connecting terminal 50 is pressed into the groove body 61*a* and the receiving portion 64 in a manner that the stop pieces 58 are pressed in a direction in which the distance between the other terminal portions thereof becomes smaller. The JB press-connecting terminal 50 is pressed into the groove body 61*a* and the receiving portion 64 and so received in the press-connecting plate 60 (or held therein or attached thereto).

The press-connecting plate 60 is made of insulative synthetic resin etc., and formed in a plate shape, that is, a flat plate shape. As shown in FIGS. 1 to 3, the press-connecting plate 60 includes a plate body 62 of a rectangular shape, a plurality of the wire receiving grooves 61 and a wire fixing portion 70. The plate body 62 includes an almost flat bottom wall 63*a*, an inner wall 65, a pair of side walls 67, a near side wall 69 as an outer wall, a plurality of separation walls 63*b* extended upward from the bottom wall 63*a*, and a flange portion 68.

The inner wall 65 continues to one edge portion of the bottom wall 63*a* which is positioned at the inner side in the figure. The inner wall 65 extends upward from the bottom wall 63*a*. The pair of the side walls 67 continue to a pair of the opposed edges of the bottom wall 63*a* and to the inner wall 65. The pair of the side walls 67 extend upward from the bottom wall 63*a* and are in parallel to each other.

Figure 6:
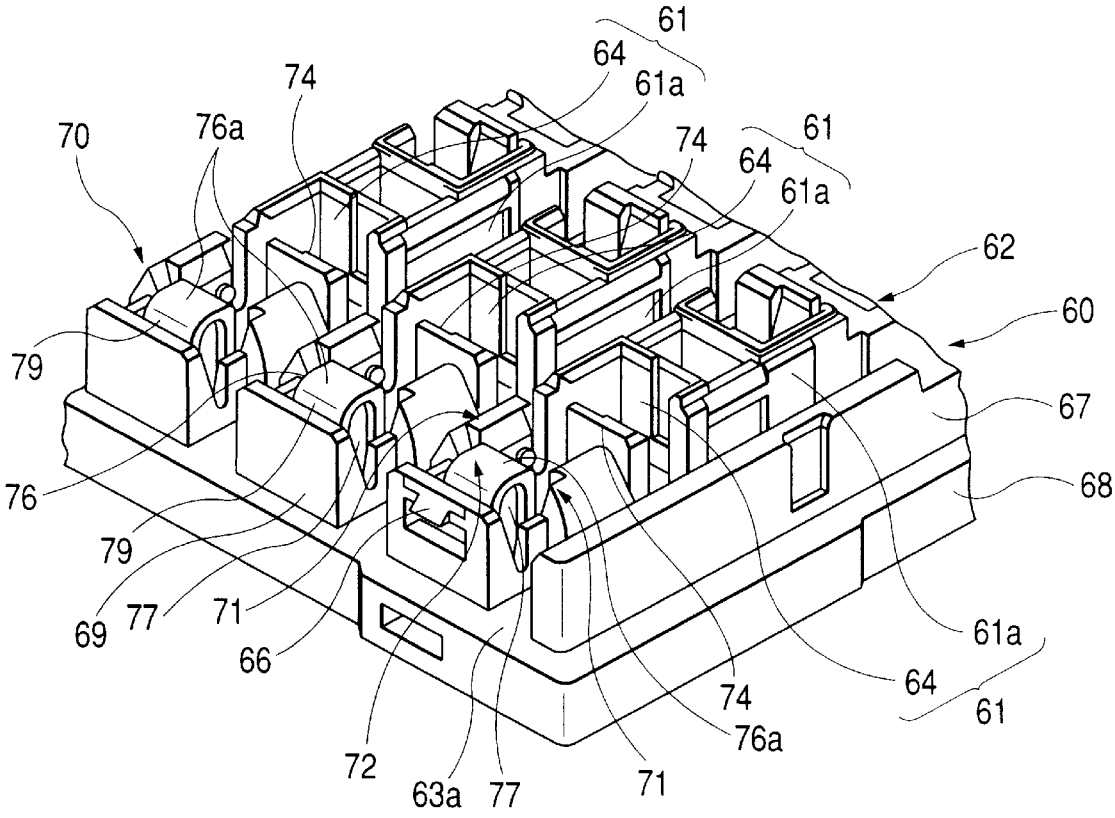
FIG. 6 is an enlarged perspective view showing a wire fixing portion of the press-connecting plate shown in FIG. 1.
Figure 7:
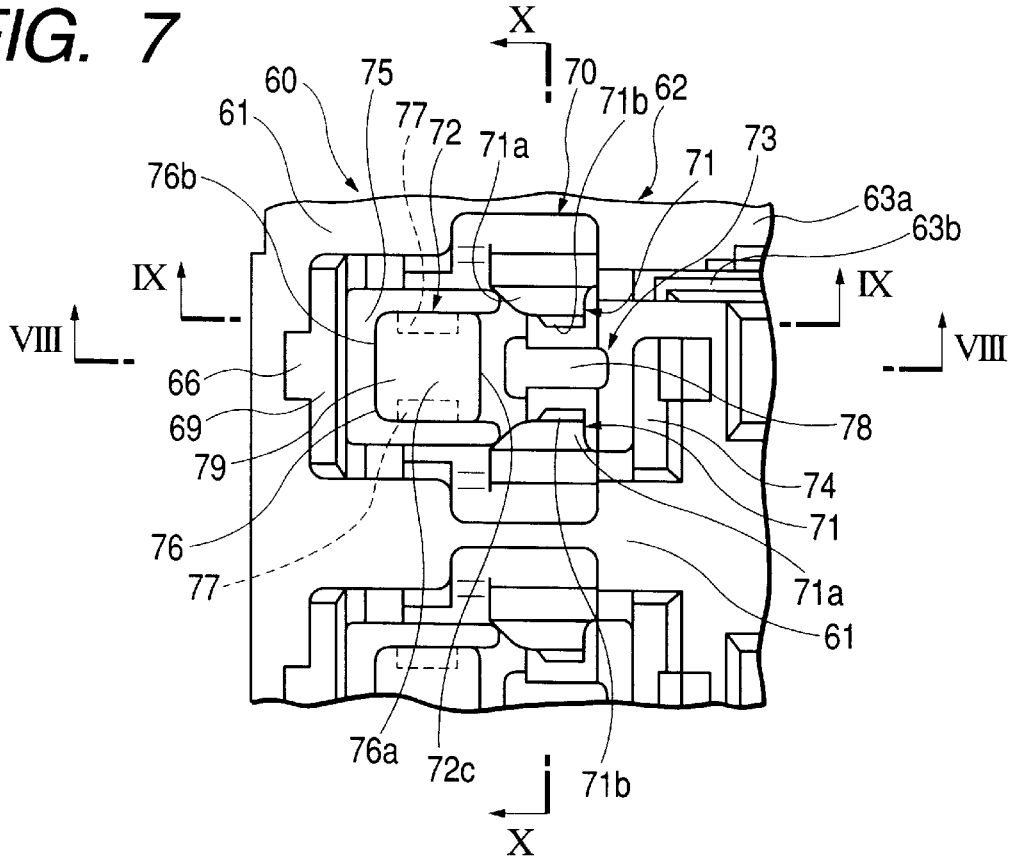
FIG. 7 is a plan view showing the wire fixing portion shown in FIG. 6.

The near side wall 69 continues to one edge portion of the bottom wall 63*a* which is positioned at the near side in the figure. The near side wall 69 extends upward from the end portion 61*b* of the bottom wall 63*a*. As shown in FIGS. 6 and 7, the near side wall 69 is disposed at a position sandwiching a withdrawal prevention wall 74 and an engagement member 72 described later. The near side wall 69 continues to each of the pair of the side walls 67. The near side wall 69 is provided with a plurality of opening portions 69*a* in which the wire receiving grooves 61 are opened.

The separation walls 63*b* are disposed in parallel from one another so as to have a space therebetween. The separation walls 63*b* are in parallel to the pair of the side walls 67. The separation walls 63*b* are disposed along the longitudinal direction of the plate body 62.

The flange portion 68 protrudes to the outer direction of the plate body 62 from the edge portion of the bottom wall 63*a*. The flange portion 68 protrudes outward from the outer surface of the inner wall 65, the side walls 67 and the near side walls 69. The flange portion 68 is provided along the entire periphery of the bottom wall 63*a*. The flange portion 68 improves the rigidity of the bottom wall 63*a*, that is, the plate body 62 to thereby prevent the bottom wall 63*a*, that is, the plate body 62 from being curved.

The wire receiving groove 61 is formed by being surrounded by the adjacent separation walls 63*b* and the bottom wall 63*a*. The wire receiving grooves 61 are juxtaposed to each other along the width direction of the plate body 62, that is, along the opposed direction of the side walls 67. The wire receiving grooves 61 are disposed in parallel from one another. The wire receiving grooves 61 extend along the longitudinal direction of the plate body 62. That is, the wire receiving grooves 61 extend along the direction in which the grooves approach and separate from the inner wall 65. The wire receiving groove 61 can receive the electric wire 4 and the JB press-connecting terminal 50 therein.

As shown in FIG. 1, the wire receiving groove 61 includes the groove body 61*a* and the receiving portion 64. The groove body 61*a* is formed by the inner surfaces of the adjacent separation walls 63*b* and the surface of the bottom wall 63*a*. The groove body 61*a* extends along the side wall 67 and the separation wall 63*b*. The groove body 61*a* receives the electric wire 4 and the wire connection portion 51 of the JB press-connecting terminal 50 therein.

The receiving portion 64 is formed in a recess shape from the separation walls 63*b* so as to expand the distance between the adjacent pair of the separation walls 63*b*. The receiving portion 64 is provided at each of the adjacent pair of the separation walls 63*b* forming the wire receiving groove 61. The receiving portion 64 is provided alternately at the one separation wall 63*b* and the other separation wall 63*b* along the longitudinal direction of the groove body 61*a*.

In this manner, a plurality of the receiving portions 64 are juxtaposed to each other along the longitudinal direction of the groove bodies 61*a* of the wire receiving grooves 61, respectively. The receiving portion 64 receives the electrical contact portion 52 of the JB press-connecting terminal 50. The receiving portion 64 is provided with a single hole which penetrates the bottom wall 63*a* of the plate body 62.

As shown in FIGS. 1, 6 and 7, the wire fixing portion 70 is provided at the end portion 61*b* away from the inner wall 65 of the wire receiving groove 61. The end portion 61*b* also serves as the end portion of the plate body 62. As shown in FIGS. 6 to 15 etc., the wire fixing portion 70 includes a retaining pawl 71, the engagement member 72, a deformation preventing projection 73, the withdrawal prevention wall 74 and a through hole 75.

The retaining pawls 71 are provided in correspondence with the wire receiving grooves 61, respectively. The two retaining pawls 71 are provided at each of the wire receiving grooves 61. The two retaining pawls 71 are provided at the both edges of the wire receiving groove 61 which are spaced to each other along the width direction of the groove. The retaining pawl 71 is formed integrally with the plate body 62 and includes a pawl body 71*a* and an engagement projection 71*b*. The pawl body 71*a* continues to the plate body 62 and extends upward from the bottom wall 63*a*.

The pawl body 71*a* retains the electric wire 4 received within the wire receiving groove 61 to thereby prevent the electric wire 4 from withdrawing from the wire receiving groove 61. The pawl bodies 71*a* of the two retaining pawls 71 provided at the wire receiving groove 61 are elastically deformable between a restriction position shown in FIGS. 21A, 21C, etc. and an allowable position shown in FIG. 21B etc.

Figure 21A:
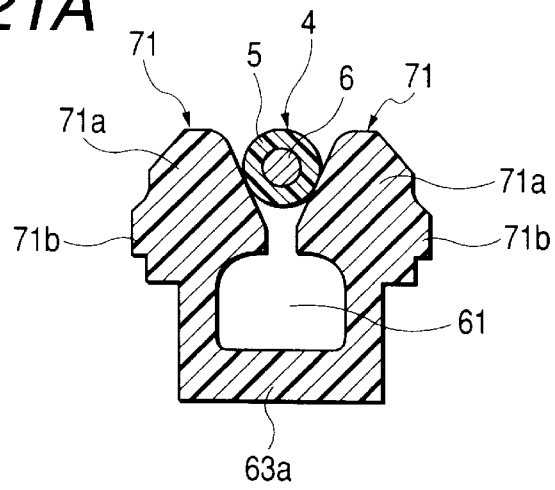
FIGS. 21A to 21C are sectional views illustrating a process of inserting with pressure an electric wire within the wire receiving groove of the press-connecting plate shown in FIG. 1.
Figure 21B:
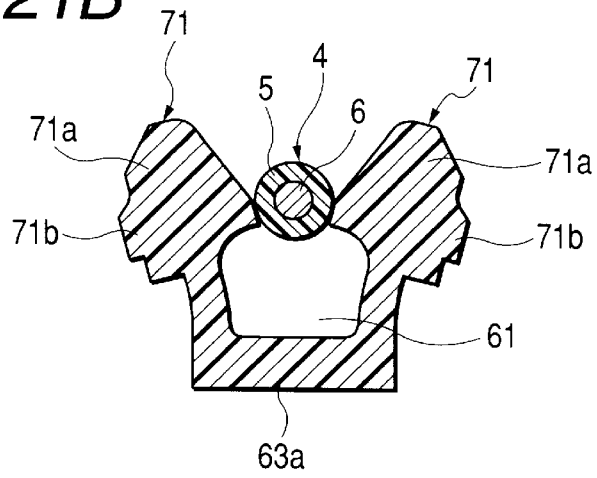
Figure 21C:
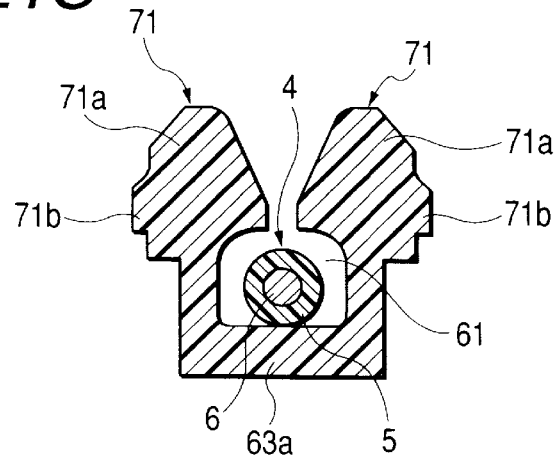
Figure 22:
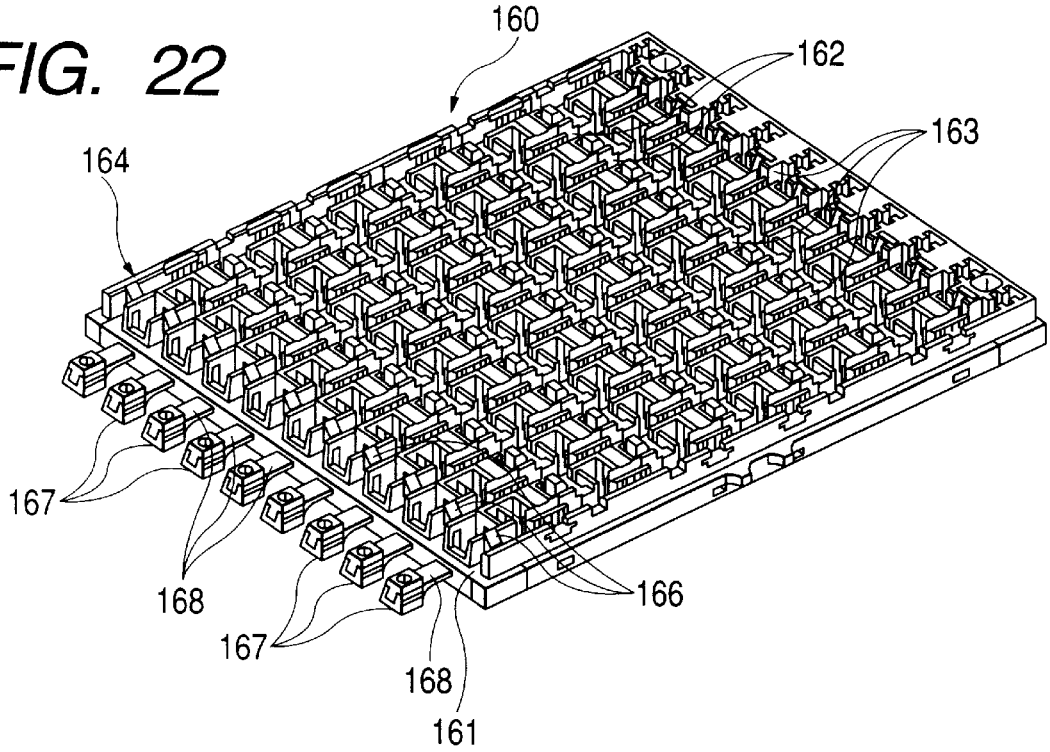
FIG. 22 is a perspective view showing a related plate-like insulating member having wire fixing portions.
Figure 23:
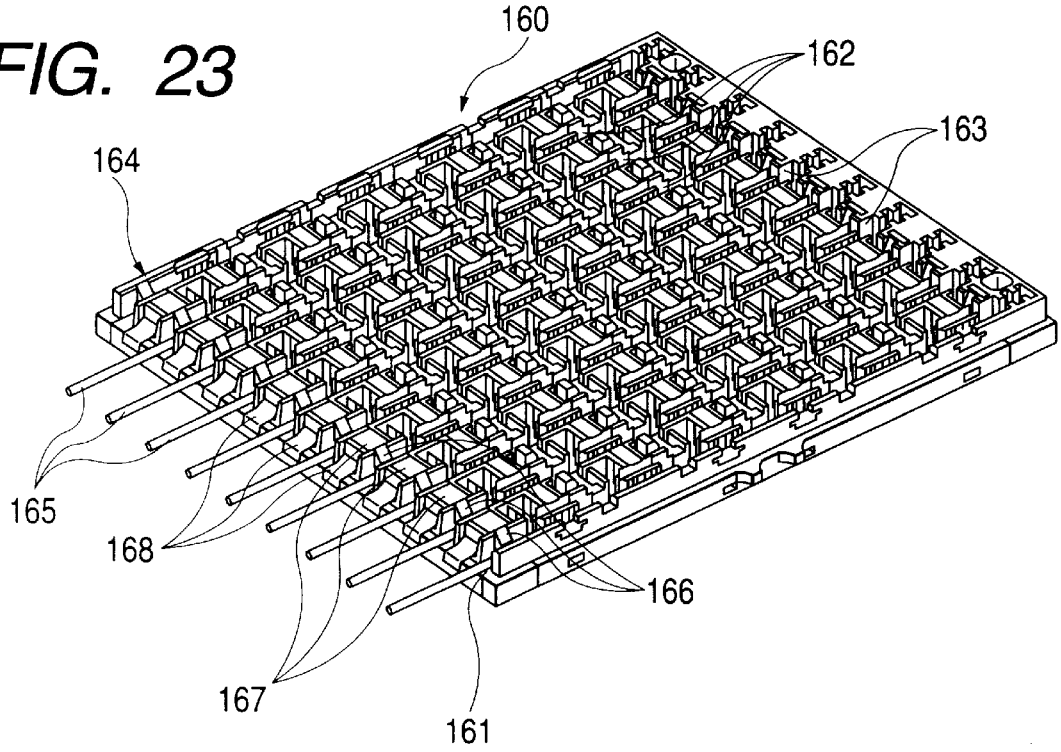
FIG. 23 is a perspective view showing the related plate-like insulating member, in which electric wires are fixed by the wire fixing portions shown in FIG. 22.

In the restriction position, as shown in FIGS. 21A, 21C, etc., the pawl bodies 71*a* of the two retaining pawls 71 are made narrower in a distance therebetween to thereby prevent the electric wire 4 received within the wire receiving groove 61 from withdrawing therefrom. In the allowable position, as shown in FIG. 21B etc., the pawl bodies 71*a* of the two retaining pawls 71 are made larger in the distance therebetween to thereby allow the electric wire 4 to withdraw from the wire receiving groove 61 and to enter into the groove. The pawl body 71*a* is located at the restriction position when it is not in an elastically deformed state (initial state).

Figure 10:
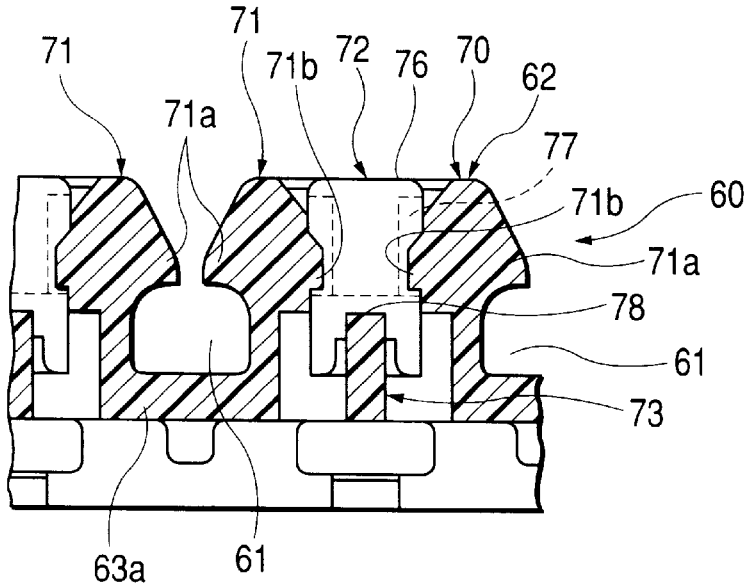
FIG. 10 is a sectional view along a line X—X in FIG. 7.

As shown in FIG. 10 etc., the engagement projections 71*b* protrude in the directions away from the pawl bodies 71*a* of the two retaining pawls 71 provided at the both edges of the wire receiving groove 61, respectively. The engagement projection 71*b* protrudes from the rear surface of the pawl body 71*a* when seen from the wire receiving groove 61. That is, the engagement projections 71*b* protrude from the pawl bodies 71*a* of the retaining pawls 71 in such a direction in which the pawl bodies 71*a* disposed at the adjacent wire receiving grooves 61 approach to each other, respectively.

Figure 8:
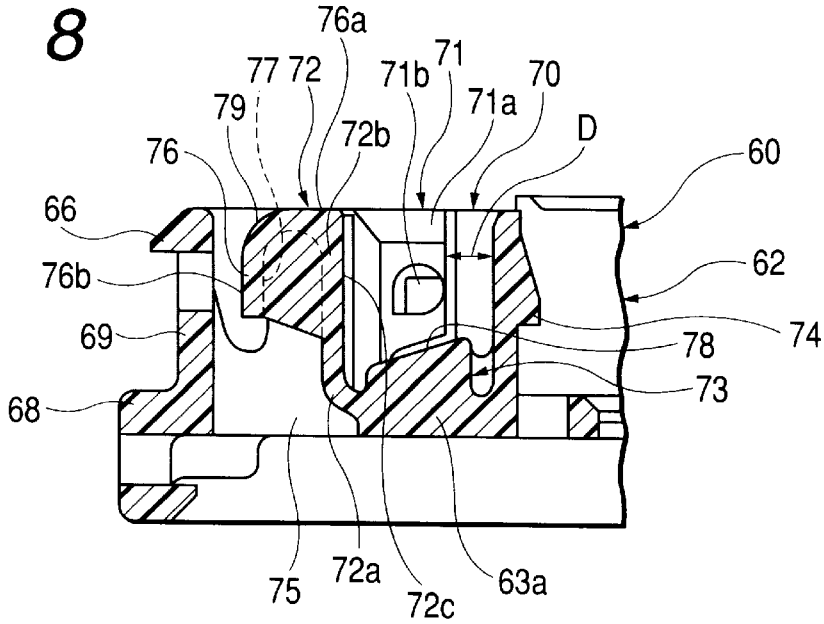
FIG. 8 is a sectional view along a line VIII—VIII in FIG. 7.
Figure 9:
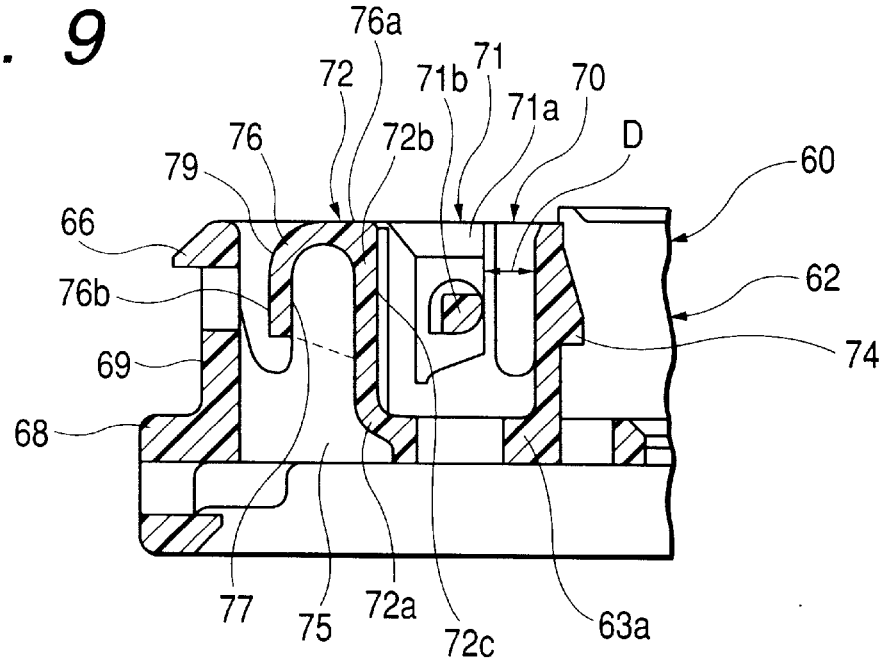
FIG. 9 is a sectional view along a line IX—IX in FIG. 7.

As shown in FIG. 7 etc., the engagement member 72 is provided between the adjacent wire receiving grooves 61 along the width direction of the wire receiving grooves 61. As shown in FIGS. 7 and 10 etc., the engagement member 72 is provided between the retaining pawls 71 disposed at the adjacent wire receiving grooves 61. The engagement members 72 are provided integrally with the plate body 62. As shown in FIGS. 8 and 9, the engagement member 72 is configured in a manner that one end 72*a* thereof continues to the bottom wall 63*a* to form an arm shape. The engagement member 72 is provided at it's the other end 72*b* with a square portion 76.

The square portion 76 is provided with an engagement recess portion 77 with which the engagement projection 71*b* can engage and a curved surface 79. The engagement recess portion 77 is formed in a recess shape from the edge of the square portion 76 so as to have a step and extends along the direction in which the one end portion 72*a* approaches to and separates from the other end portion 72*b*.

The curved surface 79 is formed so as to extend from the upper end surface 76*a* of the square portion 76 away from the bottom wall 63*a* of the plate body 62 to the surface 76*b* of the square portion 76 opposing to the near side wall 69. The curved surface 79 is formed in a convex shape in a direction away from the bottom wall 63*a*, that is, the plate body 62 and to have a smooth surface.

The engagement member 72 is configured in a manner that the engagement recess portion 77 of the square portion 76 provided at the other end portion 72*b* engages with the engagement projection 71*b* to thereby maintain the retaining pawl 71 at the restriction position. The engagement member 72 is elastically deformable between a state in which the engagement member 72 extends upward from the bottom wall 63*a* as shown in FIGS. 6 to 10 and a state in which the engagement recess portion 77 engages with the engagement projection 71*b* as shown in FIGS. 11 to 15.

The engagement member 72 extends upward from the bottom wall 63*a* and does not engage with the engagement projection 71*b* in a state not being deformed elastically (initial state). Further, the engagement member 72 is provided with an end surface 72*c* which opposes to the bottom wall 63*a* when the engagement recess portion 77 engages with the engagement projection 71*b*. The ends surface 72*c* is positioned at the other end portion 72*b*.

The deformation preventing projection 73 is provided between the adjacent wire receiving grooves 61. The deformation preventing projection 73 is provided along the width direction of the wire receiving groove 61 between the retaining pawls 71 disposed between the adjacent wire receiving grooves 61. The deformation preventing projection 73 is provided integrally with the plate body 62. The deformation preventing projection 73 is formed in a convex form from the surface of the bottom wall 63*a*. The deformation preventing projection 73 opposes to the square portion 76 which engages with the engagement projection 71*b*.

Figure 13:
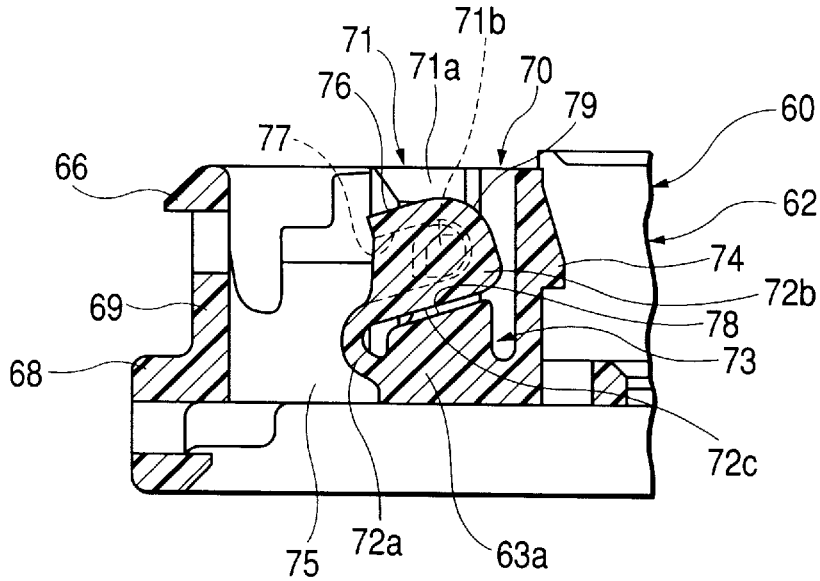
FIG. 13 is a sectional view along a line XIII—XIII in FIG. 12.

The deformation preventing projection 73 includes a restriction surface 78. As shown in FIG. 13, the restriction surface 78 opposes to the end surface 72*c* of the engagement member 72 which engages with the engagement projection 71*b*. The restriction surface 78 is formed along the end surface 72*c*. The restriction surface 78 contacts to the end surface 72*c* of the engagement member 72 which engages with the engagement projection 71*b* or is positioned in the vicinity of the end surface 72*c*.

The withdrawal prevention wall 74 is provided between the adjacent wire receiving grooves 61. The withdrawal prevention wall 74 is provided along the width direction of the wire receiving groove 61 between the retaining pawls 71 disposed between the adjacent wire receiving grooves 61. As shown in FIGS. 8 and 9 etc., the withdrawal prevention wall 74 is disposed so as to sandwich the deformation preventing projection 73 between the withdrawal prevention wall and engagement member 72 along the longitudinal direction of the wall 61. The withdrawal prevention wall 74 is formed integrally with the plate body 62 and extends upward from the bottom wall 63*a*.

A distance D (shown in FIGS. 8 and 9) from the engagement projection 71*b* to the withdrawal prevention wall 74 is set such a value that the square portion 76 does not disengage from the engagement projection 71*b* even if the square portion 76 being engaged with the engagement projection 71*b* contacts to the withdrawal prevention wall.

The through hole 75 is provided between the adjacent wire receiving grooves 61. The through hole 75 is provided along the width direction of the wire receiving groove 61 between the retaining pawls 71 disposed between the adjacent wire receiving grooves 61. As shown in FIG. 8, the through hole 75 is disposed so as t sandwich the deformation preventing projection 73 between the through hole and the withdrawal prevention wall 74 along the longitudinal direction of the wire receiving groove 61. The through hole 75 is provided along the longitudinal direction of the wire receiving groove 61 between the near side wall 69 and the deformation preventing projection 73. The through hole 75 passes through the bottom wall 63*a* of the plate body 62.

In the wire fixing portion 70 configured in the aforesaid manner, the engagement member 72 engages with the engagement projection 71*b* to thereby restrict that the pawl body 71*a* of the retaining pawl 71 displaces toward the allowable position from the restriction position. The wire fixing portion 70 prevents the electric wire 4 received within the wire receiving groove 61 from withdrawing from the groove. In this manner, the wire fixing portion 70 can displace between the restriction position and the allowable position.

The press-connecting plate 60 is provided with a plurality of stop projections 66 and a plurality of not-shown stop receiving projections. These stop projections 66 and the stop receiving projections engage to each other. These stop projections 66 and the stop receiving projections engage to each other. At the time of constructing the aforesaid stacked plate connector 1, these stop projections 66 and the stop receiving projections engage to each other to thereby fix the press-connecting plates 60 to each other.

The press-connecting plate 60 is configured so as to arrange the JB press-connecting terminals 50 on the bottom wall 63*a* in the longitudinal direction of the groove bodies 61*a* of the wire receiving grooves 61 and in the direction along which the wire receiving grooves 61 are disposed in parallel. That is, the press-connecting plate 60 is configured so as to arrange the JB press-connecting terminals 50 in a two-dimensional matrix pattern on the bottom wall 63*a*.

At the time of assembling the stacked plate connector 1, first, the JB press-connecting terminals 50 are mounted on the press-connecting plate 60. In this case, the JB press-connecting terminal 50 is brought close to the bottom wall 63*a* and attached to the plate body 62. The stop piece 58 engages with the inner surface of the separation wall 63*b*, then the JB press-connecting terminal 50 is received within the wire receiving groove 61 and fixed to the press-connecting plate 60.

Then, the electric wire 4 is press-connected to the JB press-connecting terminal 50 which is received within the body 61 and the receiving portion 64. In this case, the electric wire 4 is inserted with pressure between the press-connecting blades 54*a*, 54*b* of the wire connection portion 51 and also inserted within the wire receiving groove 61. At the time of inserting the electric wire 4 within the grove 61, the electric wire 4 is inserted with pressure between the retaining pawls 71 provided at the both edges of the wire receiving groove 61 of the wire fixing portion 70.

In this case, first, the electric wire 4 abuts against the pawl bodies 71*a* of the retaining pawls 71 as shown in FIG. 21A. When the electric wire 4 is further inserted with pressure between the pawl bodies 71*a*, the retaining pawls 71 displace to the allowable position against the elastic restoring force as shown in FIG. 21B. When the electric wire 4 is furthermore inserted with pressure within the wire receiving groove 61, the electric wire 4 is placed on the bottom wall 63*a*. Then, the retaining pawls 71 displace to the restriction position by the elastic restoring force as shown in FIG. 21C. The electric wire 4 is prevented from withdrawing from the wire receiving groove 61 by the retaining pawls 71. Then, the engagement member 72 of the wire fixing portion 70 is engaged with the engagement projections 71*b* of the retaining pawls 71 to thereby fix the electric wire 4.

Figure 16:
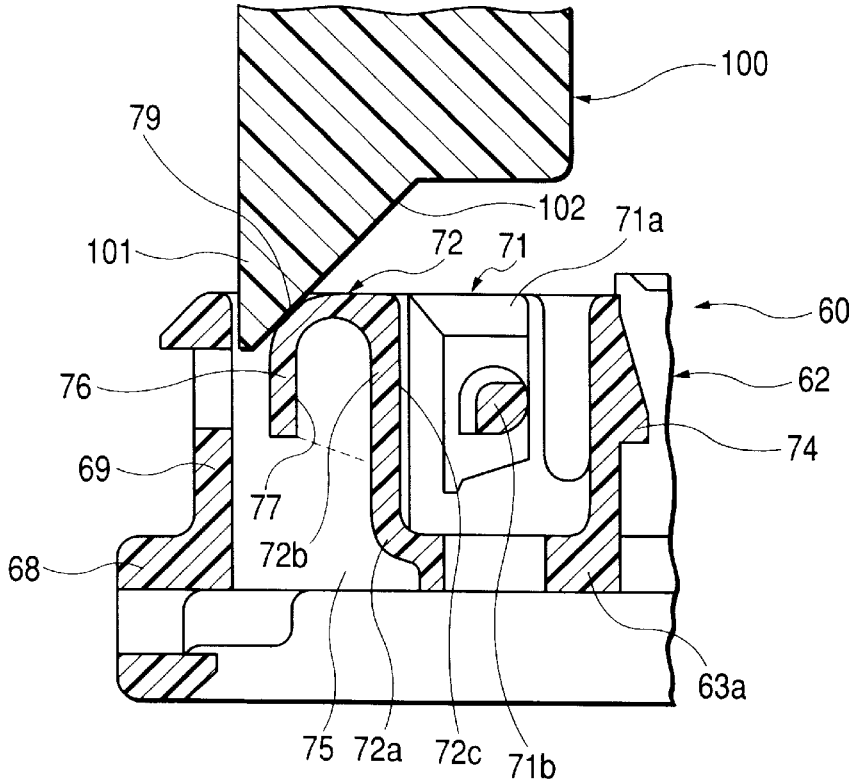
FIG. 16 is a sectional view showing a state in which a pressing member is inserted between a near wall and an engagement member shown in FIG. 6.
Figure 17:
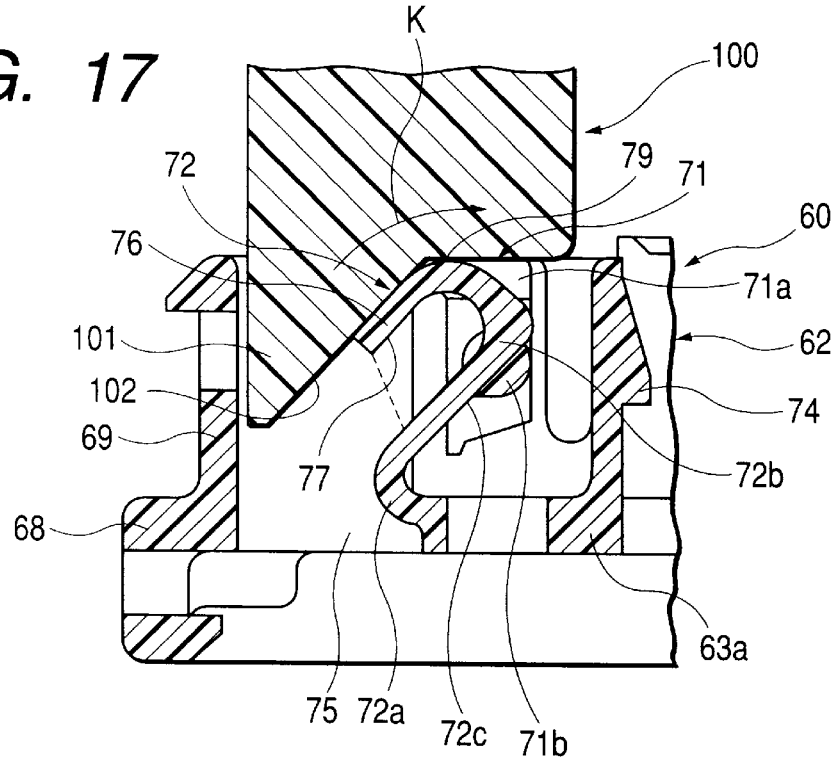
FIG. 17 is a sectional view showing a state in which the engagement member elastically deforms from the state shown in FIG. 16.
Figure 18:
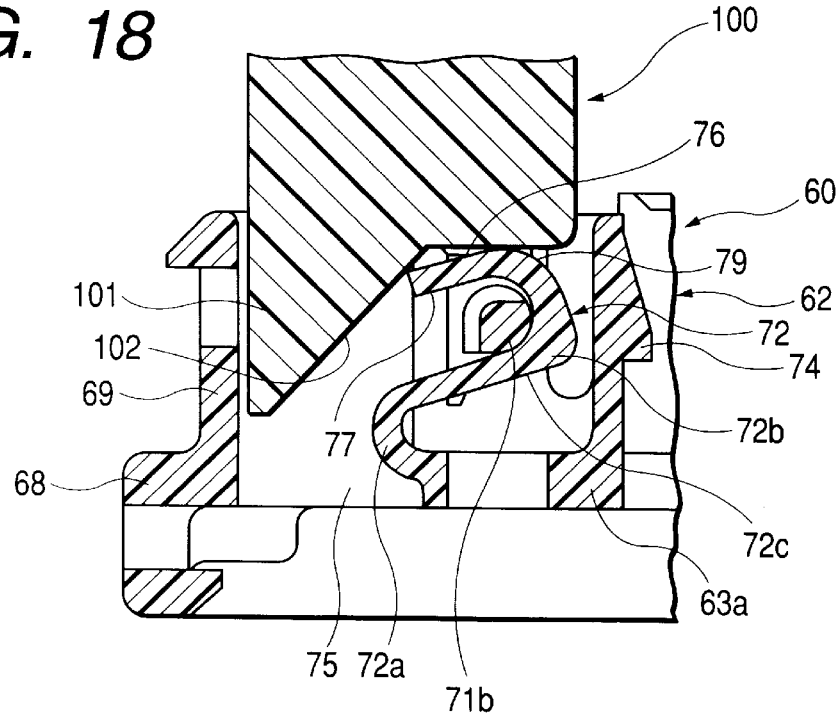
FIG. 18 is a sectional view showing a state in which the engagement member engages with engagement projections from the state shown in FIG. 17.

In this case, as shown in FIGS. 16 to 18, a pressing jig 100 serving as a jig is employed. The pressing jig 100 is provided with a wedge-shaped tapered portion 101 which thickness becomes thinner toward the tip portion thereof. The tapered portion 101 can be inserted at a portion which is between the near side wall 69 and the engagement member 72 and also between the retaining pawls 71 provided at the adjacent wire receiving grooves 61.

The tapered portion 101 is provided with a tapered surface 102 which abuts against the curved surface 79 when the tapered portion is inserted into the portion which is between the near side wall 69 and the engagement member 72 and also between the retaining pawls 71 provided at the adjacent wire receiving grooves 61. The tapered surface 102 is slanted toward the insertion direction of the tapered portion 101 so as to gradually close to the engagement member 72 as the tapered surface is away from the bottom wall 63*a*.

When the pressing jig 100 is inserted gradually from the tip end portion of the tapered portion 101 into the portion which is between the near side wall 69 and the engagement member 72 and also between the retaining pawls 71, the tapered surface 102 abuts against the curved surface 79 of the engagement member 72 as shown in FIG. 16. When the pressing jig 100 is further inserted into the portion which is between the near side wall 69 and the engagement member 72 and also between the retaining pawls 71, since the tapered surface 102 is slanted in the aforesaid manner, the engagement member 72 rotates against the elastic restoring force along an arrow K of FIG. 17 around the center of the one end portion 72*a*.

Figure 11:
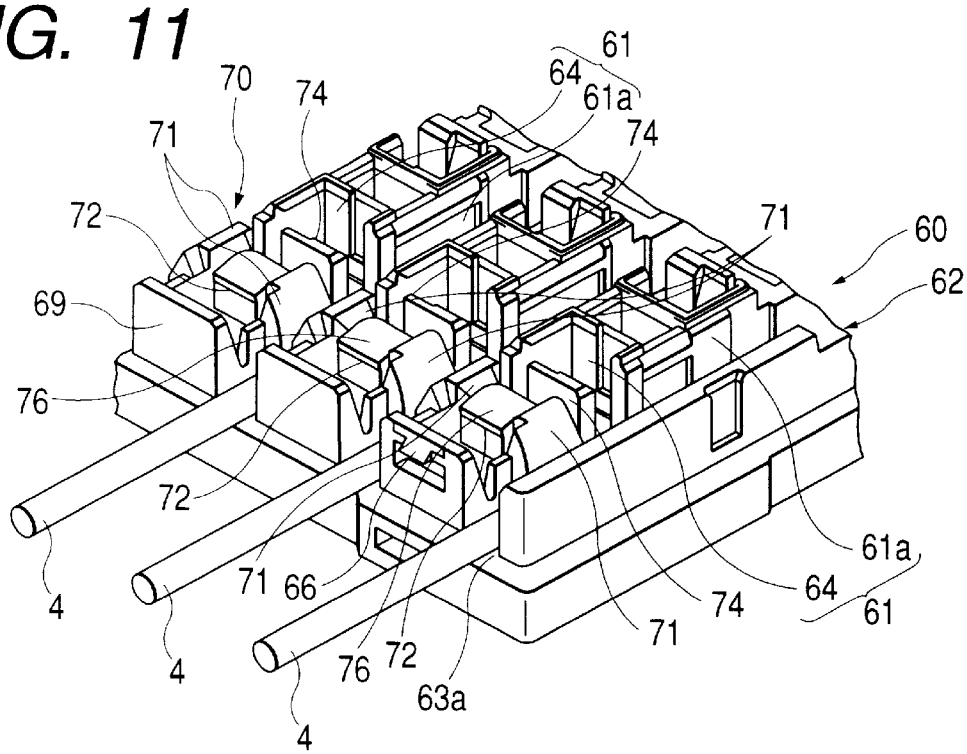
FIG. 11 is a perspective view showing a state in which the engagement member of the wire fixing portion shown in FIG. 6 engages with engagement projections.
Figure 12:
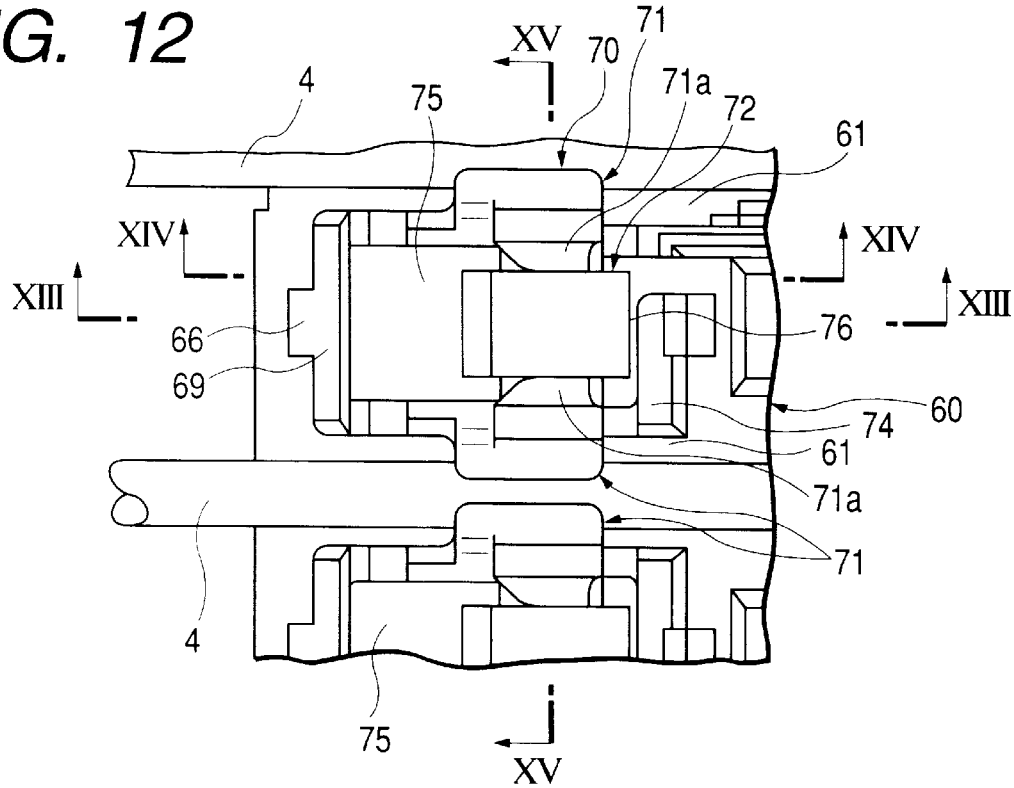
FIG. 12 is a plan view of the wire fixing portion shown in FIG. 11.
Figure 14:
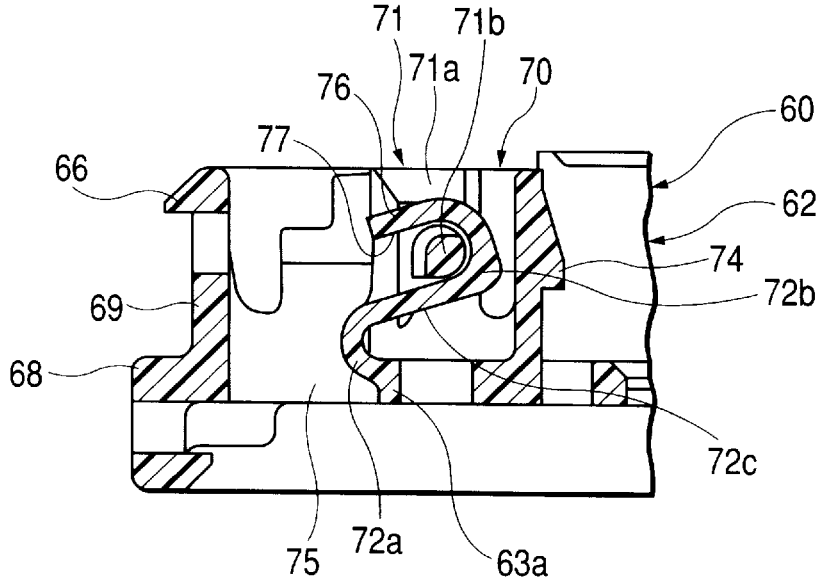
FIG. 14 is a sectional view along a line XIV—XIV in FIG. 12.
Figure 15:
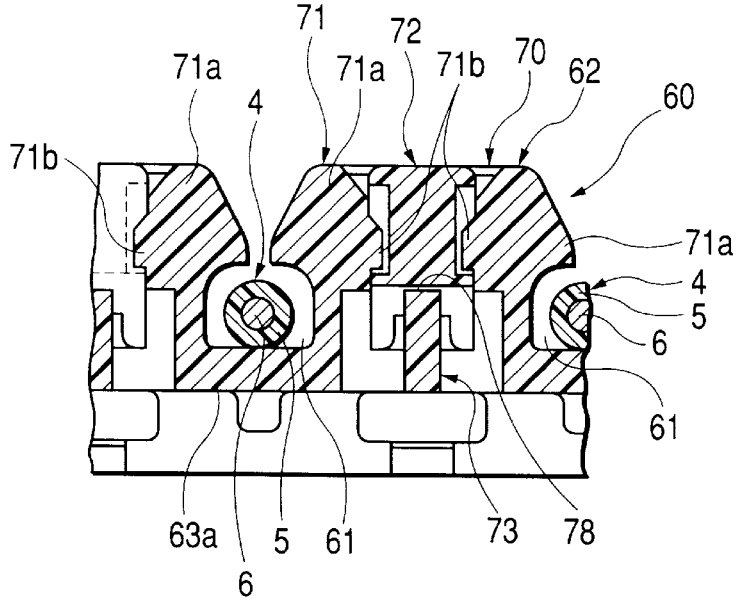
FIG. 15 is a sectional view along a line XV—XV in FIG. 12.

Then, as shown in FIG. 18, the engagement recess portion 77 of the square portion 76 engages with the engagement projections 71*b*. In this manner, the engagement member 72 is elastically deformed against the elastic restoring force and engages with the engagement projections 71*b* as shown in FIGS. 11, 12, 14, etc. When the engagement member 72 engages with the engagement projections 71*b*, the end surface 72*c* opposes to the restriction surface 78 of the deformation preventing projection 73 as shown in FIG. 13.

Further, since the engagement recess portion 77 is formed in the recess shape from the edge of the square portion 76 and extends along the direction in which the one end portion 72*a* approaches to and separates from the other end portion 72*b*, in particular, the square portion 76 of the engagement member 72 is restricted that it separates from the restriction surface 78. Furthermore, as described above, since the engagement recess portion 77 is formed, the square portion 76 is allowed to approach to the withdrawal prevention wall 74 along the restriction surface 78.

In this manner, the member 71 engages with the engagement projection 71*b* and the wire fixing portion 70 fixes the electric wire 4 so as not to withdraw from the wire receiving groove 61. In this state, as shown in FIG. 2, the press-connecting plates 60 are stacked in a manner that the plate bodies 62 are in parallel from one another and with a space therebetween.

Then, the press-connecting plates 60 are made close and fixed to each other by engaging the stop projections 66 and the stop receiving projections to each other. In the press-connecting plates 60, the connection bar 80 is inserted into the predetermined holes and the cylindrical portions 52*a* of the potions 52 to thereby configure the stacked plate connector 1 as shown in FIG. 3.

The stacked plate connector 1 is arranged in a manner that the electric wires 4 to be press-connected to the JB press-connecting terminals 50 are connected in accordance with the predetermined pattern by selecting the positions where the JB press-connecting terminals 50 are arranged on the bottom wall 63*a* and the positions where the bars 80 are inserted. The stacked plate connector 1 is received within an electric coupling box, for example, in which relays, fuses, etc., are attached to thereby connect the electric wires 4, the aforesaid relays, fuses, etc., in accordance with a predetermined pattern.

According to the first embodiment, the pawl body 71*a* of the retaining pawl 71 is deformable between the restriction position and the allowable position. The pawl body 71*a* is positioned at the restriction position at the initial state. Thus, the electric wire 4 can be received within the wire receiving groove 61 by inserting with pressure the electric wire 4 between the pawl bodies 71*a*. Further, the electric wire 4 thus received can be prevented from withdrawing from the wire receiving groove 61 suddenly. Thus, since the electric wire can be received within the wire receiving groove 61 by inserting the electric wire 4 with pressure between the pawl bodies 71*a*, the electric wire 4 can easily be attached to the press-connecting plate 60.

When the square portion 76 of the engagement member 72 is engaged with the engagement projections 71*b* of the retaining pawls 71, the pawl bodies 71*a* is prevented from displacing from the restriction position to the allowable position and held at the restriction position. Thus, the electric wire 4 can be surely fixed within the wire receiving groove 61. In this manner, since the electric wire can be fixed within the wire receiving groove 61 by inserting the electric wire 4 with pressure between the pawl bodies 71*a* and by engaging the square portion 76 of the engagement member 72 against the engagement projections 71*b*, the electric wire 4 can easily be fixed to the press-connecting plate 60.

Further, the engagement member 72 of the wire fixing portion 70 is provided between the adjacent wire receiving grooves 61. Thus, the engagement member 72 of the wire fixing portion 70 does not protrude outward from the plate body 62 of the press-connecting plate 60. Accordingly, at the time of assembling the stacked plate connector 1 by performing such an operation of stacking the press-connecting plates 60 to which the JB press-connecting terminals 50 are attached, the engagement member 72 can be prevented from contacting to a worker, an assembling apparatus, etc. Therefore, the wire fixing portion 70 can be prevented from being broken suddenly during the assembling operation of the stacked plate connector 1.

The engagement member 72 is elastically deformed against the elastic restoring force and engages with the engagement projections 71*b*. The engagement member 72 does not engage with the engagement projections 71*b* and extends upward from the bottom wall 63*a* in the initial state. Thus, the engagement member 72 scarcely engages with the engagement projections 71*b* before inserting the electric wire 4 with pressure between the pawl bodies 71*a*. Therefore, the wire fixing portion 70 does not prevent the electric wire 4 from being received within the wire receiving groove 61.

Further, the retaining pawls 71, the engagement members 72, the deformation preventing projections 73 and the withdrawal prevention walls 74 are formed integrally with the plate body 62. Thus, the number of the parts of the press-connecting plate 60 can be prevented from being, increased. Further, since the wire fixing portion 70 is provided at the end portion 61*b* of the wire receiving groove 61, the enlargement of the plate body 62, that is, the press-connecting plate 60 itself can be suppressed. Therefore, the enlargement and increase of the cost of the press-connecting plate 60 can be suppressed.

Further, since the retaining pawls and the engagement members are formed integrally with the plate body 62, the retaining pawls 71 and the engagement members 72 of the wire fixing portions 70 can be elastically deformed surely.

The restriction surface 78 of the deformation preventing projection 73 opposes to the end surface 72*c* of the engagement member 72 which engages with the engagement projections 71*b*. Thus, when the engagement member is forced to be further deformed against the elastic restoring force after the engagement member 72 engages with the engagement projections 71*b*, the end surface 72*c* contacts to the restriction surface 78, whereby the restriction surface 78 prevents the engagement member 72 from being deformed excessively.

Therefore, the engagement member 72 is prevented from causing such a phenomenon that the engagement member is deformed excessively exceeding the elastic limit and the one end portion 72*a* is broken. The engagement member 72 is prevented from causing such a phenomenon that the one end portion 72*a* is broken and the engagement member is separated from the plate body 62. Therefore, after the engagement member 72 is engaged with the engagement projections 71*b* to thereby fix the electric wire 4, the electric wire 4 can be surely prevented from withdrawing from the wire receiving groove 61 suddenly.

Figure 20:
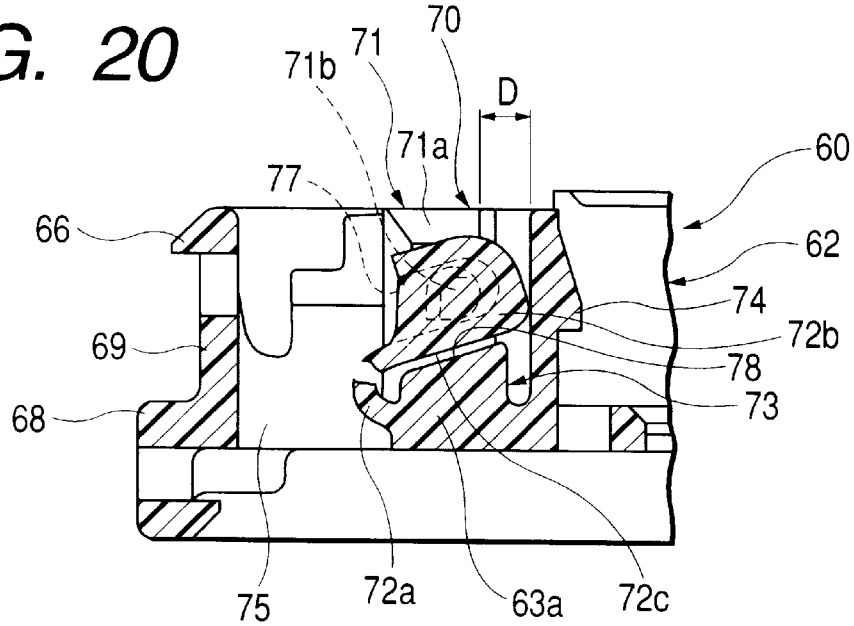
FIG. 20 is a sectional view showing a state in which the engagement member is separated from a plate body from the state shown in FIG. 18.

The square portion 76 of the wire fixing portion 70 is restricted from separating from the restriction surface 78. Thus, for example, as shown in FIG. 20, god even if the one end portion 72*a* is broken and the engagement member 72 separates from the plate body 62, since the square portion 76 does not separate from the restriction surface 78, the square portion 76 continues to engage with the engagement projections 71*b*. Therefore, after the square portion 76 is engaged with the engagement projections 71*b* to fix the electric wire 4, the electric wire 4 can be surely prevented from withdrawing from the wire receiving groove 61 suddenly.

Further, the withdrawal prevention wall 74 is provided between the pawl bodies 71*a* disposed in the adjacent wire receiving grooves 61 and extends upward from the end portion 61*b* of the plate body 62. Furthermore, the square portion 76 is allowed to approach to the withdrawal prevention wall 74 along the restriction surface 78.

Thus, when the one end portion 72*a* is broken and the engagement member 72 separates from the plate body 62 to thereby displace along the restriction surface 78, the square portion 76 contacts to the withdrawal prevention wall 74 as shown in FIG. 20. The engagement state between the square portion 76 and the engagement projections 71*b* is maintained. Thus, after the square portion 76 is engaged with the engagement projections 71*b* to fix the electric wire 4, the electric wire 4 can be surely prevented from withdrawing from the wire receiving groove 61 suddenly.

A convex-shaped curved surface 79 is formed at the square portion 76, that is, the other end portion 72*b* of the engagement member 72 in the direction away from the plate body 62. Thus, when a jig such as the pressing jig 100 is inserted between the near side wall 69 and the engagement member 72 from the tip end of the wedge-shaped tapered portion 101, the engagement member is guided by the tapered surface 102 an the curved surface 79 and elastically deformed gradually in the direction in which the square portion 76 engages with the engagement projections 71*b*. When the pressing jig 100 is further inserted, the square portion 76 engages with the engagement projections 71*b*.

In this manner, since the square portion 76 can be engaged with the engagement projections 71*b* by inserting the pressing jig 100 between the near side wall 69 and the engagement member 72, the electric wire 4 can easily be fixed to the press-connecting plate 60.

Figure 19:
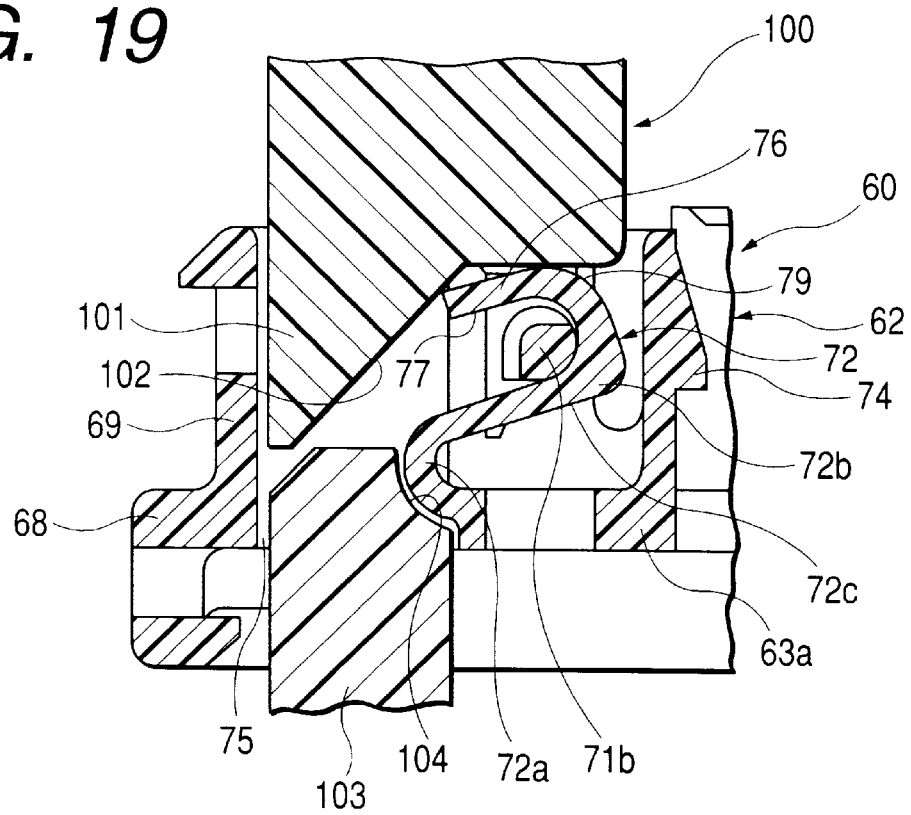
FIG. 19 is a sectional view showing a state in which the engagement member is engaged with the engagement projections by using a grip pressing member in addition to a pressing member shown in FIG. 16.

Further, in the present invention, at the time of engaging the square portion 76 of the engagement member 72 with the engagement projections 71*b*, a grip pushing jig 103 may be employed in addition to the pressing jig 100 as shown in FIG. 19. The pushing jig 103 is formed in a column shape so as to be able to be inserted within the through hole 75 and provided with a pushing surface 104 along the outer shape of the one end portion 72*a* of the engagement member 72. The pushing surface 104 is provided at the tip end portion of the pushing jig 103 and formed as a concave curved surface from the surface of this tip end portion.

At the time of inserting the pressing jig 100 between the near side wall 69 and the engagement member 72, the pushing jig 103 is inserted between the near side wall 69 and the engagement member 72 by passing through the through hole 75 from the reverse side of the pressing jig 100. In this case, the pushing surface 104 contacts to the one end portion 72*a*. Since the pushing surface 104 is provided so as to be along the one end portion 72*a*, the pressing surface supports the one end portion 72*a*.

Thus, at the time of engaging the square portion 76 with the engagement projections 71*b* by using the pressing jig 100, the square portion 76 and the engagement projections 71*b* are prevented from displacing due to the elastic restoring force of the engagement member 72 etc. The square portion 76 surely engages with the engagement projections 71*b*. In this manner, since the engagement member 72 surely engages with the engagement projections 71*b* by inserting the pressing jig 100 and the pushing jig 103 at a portion which is between the pawl bodies 71*a* and between the near side wall 69 and the engagement member 72, the electric wire 4 can easily be fixed to the press-connecting plate 60.

As described above, according to the embodiments, the pawl body of the retaining pawl is deformable between the restriction position and the allowable position. Thus, the electric wire can be received within the wire receiving groove by inserting with pressure the electric wire between the pawl bodies. Therefore, the electric wire can easily be attached.

Further, when the engagement member is engaged with the engagement projections of the retaining pawls, the pawl bodies are restricted from displacing to the allowable position from the restriction position to thereby hold the pawl bodies at the restriction position. Thus, the electric wire can be fixed surely within the wire receiving groove. In this manner, the electric wire can easily be fixed by inserting the electric wire with pressure between the pawl bodies and engaging the engagement member with the engagement projections.

Further, the engagement member is provided between the pawl bodies disposed between the adjacent wire receiving grooves, so that the engagement member does not protrude outward of the plate-like insulating member. Thus, at the time of assembling the plate connector by, for example, stacking the plate-like insulating members at each of which the press-connecting terminals are attached, the engagement member can be prevented from contacting to a worker, an assembling apparatus, etc. Therefore, the engagement member is prevented from being broken suddenly during the assembling procedure of the plate connector.

According to the embodiments, the pawl body is elastically deformable between the restriction position and the allowable position and positioned at the restriction position in the initial state. Thus, the electric wire can be received surely within the wire receiving groove by inserting the electric wire with pressure between the pawl bodies. Therefore, the electric wire can easily be fixed and can be prevented from being broken during the assembling procedure. In addition, the electric wire inserted with pressure between the pawl bodies can be prevented from withdrawing from the wire receiving groove suddenly.

Further, the engagement member is deformed against the elastic restoring force and engaged with the engagement projections. Thus, the engagement member scarcely engages with the engagement projections before inserting the electric wire with pressure between the pawl bodies. Therefore, the wire fixing portion does not interfere the operation of inserting the electric wire within the wire receiving groove.

According to the embodiments, the plate body is formed integrally with the retaining pawls and the engagement members. Thus, increase of the number of the parts of the plate-like insulating member can be suppressed. Further, since the retaining pawl is provided at the end portion of the wire receiving groove, enlargement of the plate body, that is, the plate-like insulating member can be suppressed. Therefore, the electric wire can easily be fixed and can be prevented from being broken during the assembling procedure. In addition, the enlargement of the plate-like insulating member and the increase of the cost thereof can be suppressed.

Further, since the retaining pawls and the engagement members are formed integrally with the plate body, the retaining pawls and the engagement members are surely and elastically deformable. Thus, the electric wire can be more surely received within the wire receiving groove, and the wire fixing portion further does not interfere the operation of inserting the electric wire within the wire receiving groove.

According to the embodiments, the deformation preventing projection is provided with the restriction surface which protrudes from the plate-like insulating member and opposes to the end surface of the engagement member engaging with the engagement projections. The restriction surface serves to prevent the engagement member from being deformed excessively. Thus, the engagement member is prevented from causing such a phenomenon that the engagement member is deformed excessively exceeding the elastic limit and the one end portion is broken and the engagement member is separated from the plate body. Therefore, the electric wire can easily be fixed and can be prevented from being broken during the assembling procedure. In addition, such a phenomenon is surely prevented from occurring that the electric wire comes out of the wire receiving groove after engaging the engagement member with the engagement projections to fix the electric wire.

According to the embodiments, the other end portion of the engagement member is restricted from separating from the restriction surface even if the one end portion of the engagement member is broken and the engagement member is separated from the plate body. Thus, the engagement member continues to engage with the engagement projections. Therefore, the electric wire can easily be fixed and can be prevented from being broken during the assembling procedure. In addition, such a phenomenon is prevented further surely from occurring that the electric wire comes out of the wire receiving groove after engaging the engagement member with the engagement projections to fix the electric wire.

According to the embodiments, the withdrawal prevention wall is provided between the pawl bodies disposed in the adjacent wire receiving grooves and extends upward from the end portion of the plate body. Thus, when the one end portion of the engagement member is broken and the engagement member is separated from the plate body, the engagement member contacts to (interferes with) the withdrawal prevention wall even if the engagement member is forced to displace along the restriction surface, so that the engagement member continues to engage with the engagement projections. Thus, the electric wire can easily be fixed and can be prevented from being broken during the assembling procedure. In addition, such a phenomenon is prevented further surely from occurring that the electric wire comes out of the wire receiving groove after engaging the engagement member with the engagement projections to fix the electric wire.

According to the embodiments, the convex-shaped curved surface is formed at the other end portion of the engagement member in the direction away from the plate body. Thus, when a jig such as a wedge-shaped jig is inserted from the tip end thereof between the engagement member and the outer wall, the engagement member is elastically deformed gradually by the curved surface in a direction of engaging with the engagement projections. In this manner, since the engagement member can be engaged with the engagement projections by inserting the wedge-shaped jig between the engagement member and the outer wall, the electric wire can easily be fixed to the plate-like insulating member.

According to the embodiments, the pressing jig is inserted from the tip end thereof into the portion which is between the pawl bodies disposed at the adjacent wire receiving grooves and also between the engagement member and the outer wall. Thus, the engagement member is elastically deformed gradually by the curved surface etc., in the direction of engaging with the engagement projections and engages with the engagement projections. In this manner, since the engagement member can be engaged with the engagement projections by inserting the pressing jig into the portion which is between the pawl bodies and also between the engagement member and the outer wall, the electric wire can easily be fixed to the plate-like insulating member.

According to the embodiments, the pushing jig is inserted through the through hole into the portion which is between the pawl bodies disposed at the adjacent wire receiving grooves and also between the engagement member and the outer wall. Then, the pushing surface of the pushing jig contacts to the one end portion of the engagement member.

Thus, at the time of engaging the engagement member with the engagement projections by using the pressing jig, the pushing surface supports the one end portion of the engagement member. Therefore, eve if the other end portion and the engagement projections are forced to shift to each other due to the elastic restoring force of the engagement member etc., the other end portion can surely engage with the engagement projections since the one end portion is supported.

In this manner, since the engagement member can be engaged surely with the engagement projections by inserting the pressing jig and the pushing jig into the portion which is between the pawl bodies and also between the engagement member and the outer wall, the electric wire can easily be fixed to the plate-like insulating member.

A second embodiment of the present invention now will be described with reference to FIGS. 24 to 32. For better understanding, the second embodiment will be described as a modification of the first embodiment already described above.

Figure 24:
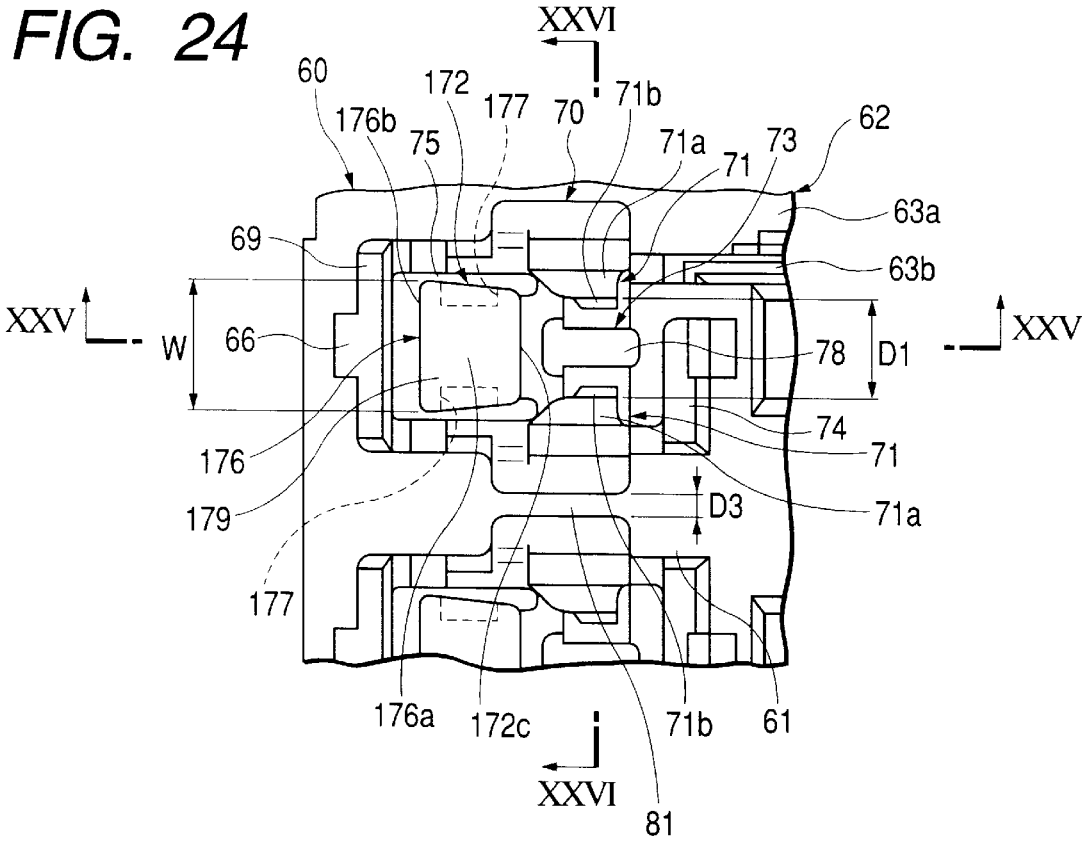
FIG. 24 is a plan view of a wire fixing portion according to a second embodiment of the present invention.

As shown in FIG. 24, the wire fixing portion 70 is provided at the end portion 61*b* away from the inner wall 65 of the wire receiving groove 61. The end portion 61*b* also serves as the end portion of the plate body 62. As shown in FIGS. 24 to 30, the wire fixing portion 70 includes a retaining pawl 71, an engagement member 172, a deformation preventing projection 73, the withdrawal prevention wall 74 and a through hole 75.

The retaining pawls 71 are provided in correspondence with the wire receiving grooves 61, respectively. The two retaining pawls 71 are provided at each of the wire receiving grooves 61. The two retaining pawls 71 are provided so as to extend upward from the both edges of the wire receiving groove 61 which are spaced to each other along the width direction of the groove, respectively. The retaining pawl 71 is formed integrally with the plate body 62 and includes a pawl body 71*a* and an engagement projection 71*b*. The pawl body 71*a* continues to the plate body 62 and extends upward from the bottom wall 63*a*.

The pawl body 71*a* retains the electric wire 4 received within the wire receiving groove 61 to thereby prevent the electric wire 4 from withdrawing from the wire receiving groove 61. The pawl bodies 71*a* of a pair of the retaining pawls 71 provided at the wire receiving groove 61 are elastically deformable between a restriction position shown in FIGS. 31A, 31C, etc., and an allowable position shown in FIG. 31B etc. That is, the retaining pawl 71 can displace between the restriction position and the allowable position.

In the restriction position, the pawl bodies 71*a* of the two retaining pawls 71 are made narrower in a distance therebetween to thereby prevent the electric wire 4 received within the wire receiving groove 61 from with drawing therefrom. In the allowable position, the pawl bodies 71*a* of the two retaining pawls 71 are made larger in the distance therebetween to thereby allow the electric wire 4 to withdraw from the wire receiving groove 61 and to enter into the wire receiving groove 61.

The pawl body 71*a* is located at the restriction position when it is not in an elastically deformed state (initial state). Further, in the restriction position, as shown in FIGS. 24 and 26, a gap 81 with a distance D3 exists between the pawl bodies 71*a* of the pair of the retaining pawls 71 extended upward from the both edges of the wire receiving groove 61.

Figure 26:
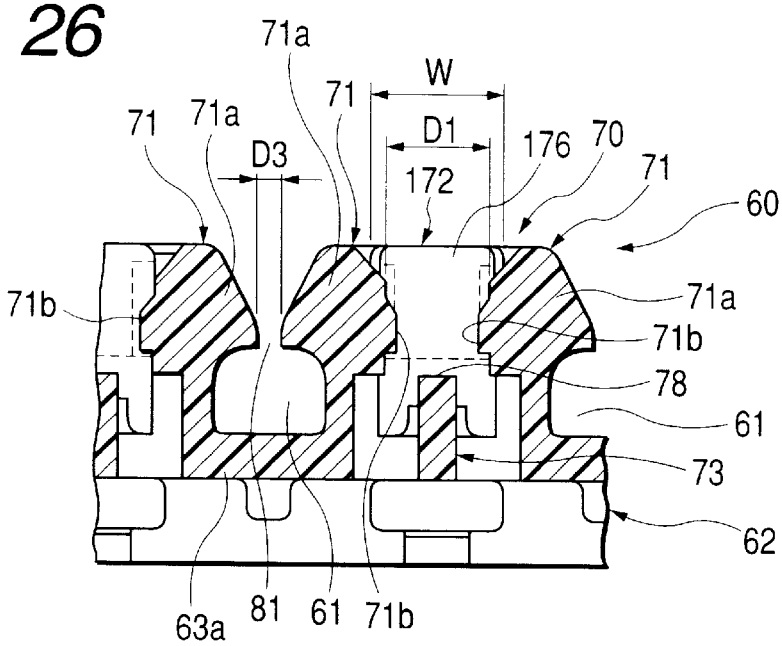
FIG. 26 is a sectional view along a line XXVI—XXVI in FIG. 24.
Figure 27:
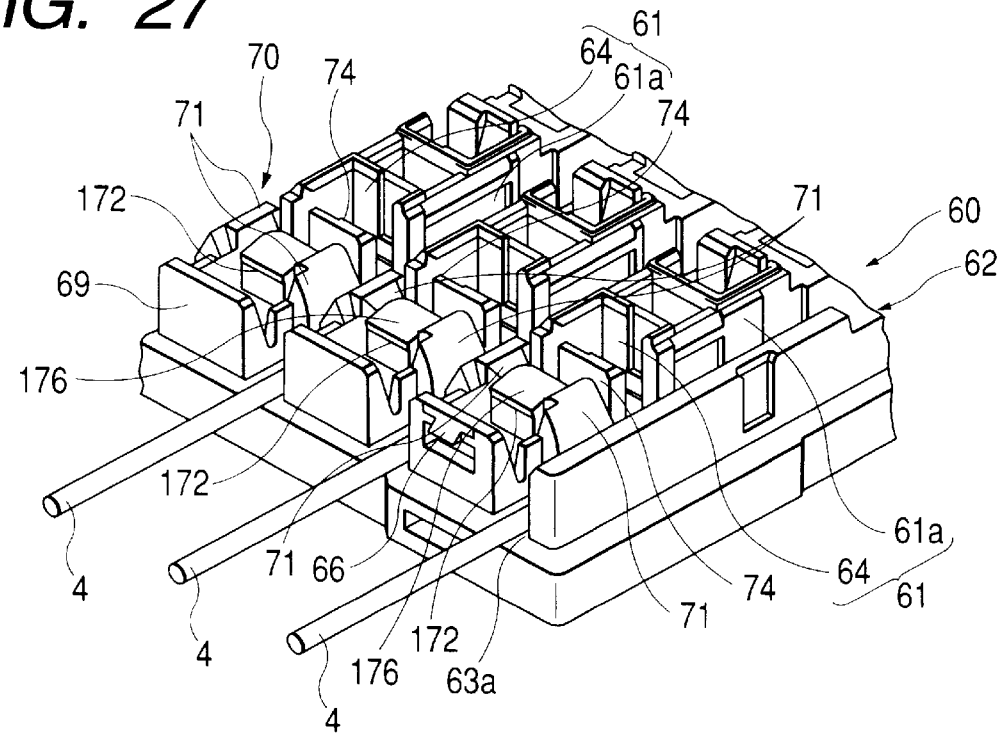
FIG. 27 is a perspective view showing a state in which the engagement member of the wire fixing portion engages with engagement projections.
Figure 28:
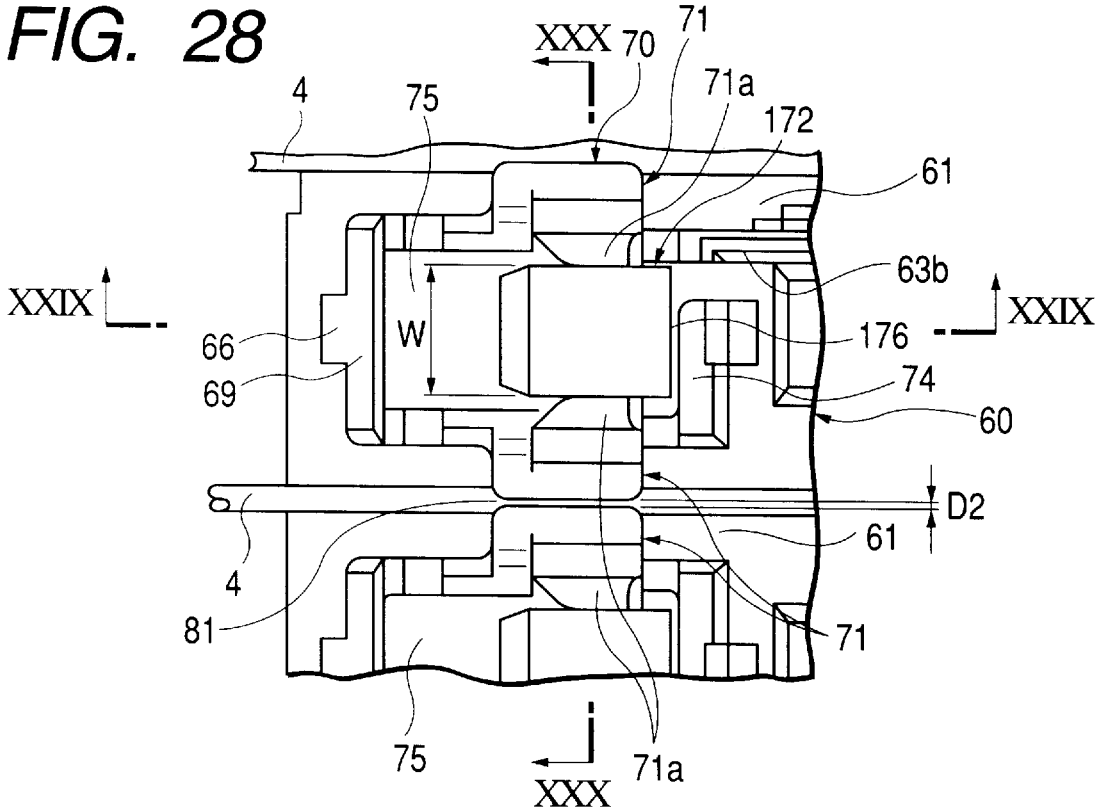
FIG. 28 is a plan view of the wire fixing portion shown in FIG. 27.

As shown in FIGS. 24, 26, etc., the engagement projections 71*b* protrude in the directions away from the pawl bodies 71*a* of the pair of the retaining pawls 71 extended upward from the both edges of the wire receiving groove 61, respectively. The engagement projection 71*b* protrudes from the rear surface of the pawl body 71*a* when seen from the wire receiving groove 61. That is, the engagement projections 71*b* protrude from the pawl bodies 71*a* of the retaining pawls 71 in such a direction that the pawl bodies 71*a* extended upward from the edges of the adjacent wire receiving grooves 61 approach to each other, respectively.

Figure 25:
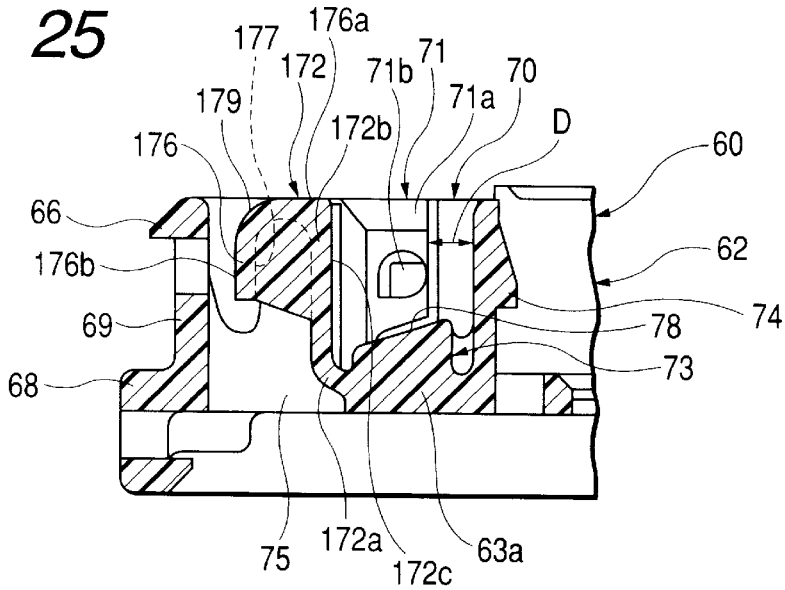
FIG. 25 is a sectional view along a line XXV—XXV in FIG. 24.

As shown in FIG. 24 etc., the engagement member 172 is provided between the adjacent wire receiving grooves 61 along the width direction of the wire receiving grooves 61. As shown in FIGS. 24, 26, etc., the engagement member 172 is provided between the retaining pawls 71 extended upward from the edges of the adjacent wire receiving grooves 61. The engagement members 172 are provided integrally with the plate body 62. As shown in FIG. 25 etc., the engagement member 172 is configured in a manner that one end 172*a* thereof continues to the bottom wall 63*a* to form an arm shape. The engagement member 172 is provided at it's the other end 172*b* with a square portion 176.

The square portion 176 is provided with an engagement recess portion 177 with which the engagement projection 71*b* can engage, and a curved surface 179. The engagement recess portion 177 is formed in a recess shape from the edge of the square portion 176 so as to have a step and extends along the direction in which the one end portion 172*a* approaches to and separates from the other end portion 172*b*.

The curved surface 179 is formed so as to extend from the upper end surface 176*a* of the square portion 176 away from the bottom wall 63*a* of the plate body 62 to the surface 176*b* of the square portion 176 opposing to the near side wall 69. The curved surface 179 is formed in a convex shape in a direction away from the bottom wall 63*a*, that is, the plate body 62 and to have a smooth surface.

A width W (shown in FIGS. 24 and 26) along the width direction of the wire receiving groove 61 of the square portion 176 of the engagement member 172 is formed to be larger than a distance D1 (shown in FIGS. 24 and 26) between the pawl bodies 71*a* of the retaining pawls 71 extended upward from the edges of the adjacent wire receiving grooves 61 at the restriction position. In this manner, the engagement member 172 is formed in a manner that the width W along the width direction of the wire receiving groove 61 is larger than the distance D1 between the retaining pawls 71 at the restriction position.

The engagement member 172 is configured in a manner that the engagement recess portion 177 of the square portion 176 provided at the other end portion 172*b* engages with the engagement projection 71*b* to thereby maintain the retaining pawl 71 at the restriction position. The engagement member 172 is elastically deformable between a state in which the engagement member 172 extends upward from the bottom wall 63*a* as shown in FIGS. 24 to 26 etc., and a state in which the engagement recess portion 177 engages with the engagement projection 71*b* as shown in FIGS. 27 to 30.

The engagement member 172 extends upward from the bottom wall 63*a* and does not engage with the engagement projection 71*b* in a state not being deformed elastically (initial state). Further, the engagement member 172 is provided with an end surface 172*c* which opposes to the bottom wall 63*a* when the engagement recess portion 177 engages with the engagement projection 71*b*. The end surface 172*c* is provided at the other end portion 172*b*.

The deformation preventing projection 73 is provided between the adjacent wire receiving grooves 61. The deformation preventing projection 73 is provided along the width direction of the wire receiving groove 61 between the retaining pawls 71 disposed at the edges of the adjacent wire receiving grooves 61. The deformation preventing projection 73 is provided integrally with the plate body 62. The deformation preventing projection 73 is formed in a convex form from the surface of the bottom wall 63*a*. The deformation preventing projection 73 opposes to the square portion 176 which engages with the-engagement projection 71*b*.

Figure 29:
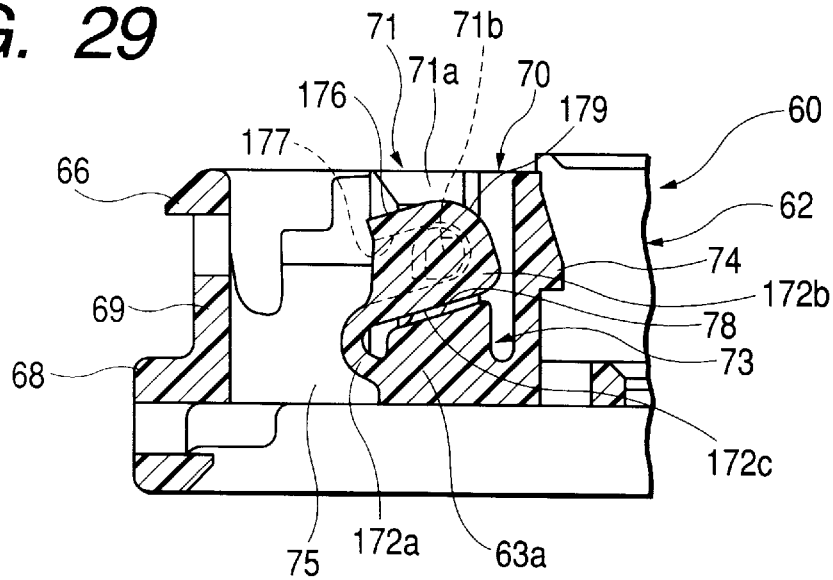
FIG. 29 is a sectional view along a line XXIX—XXIX in FIG. 28.
Figure 30:
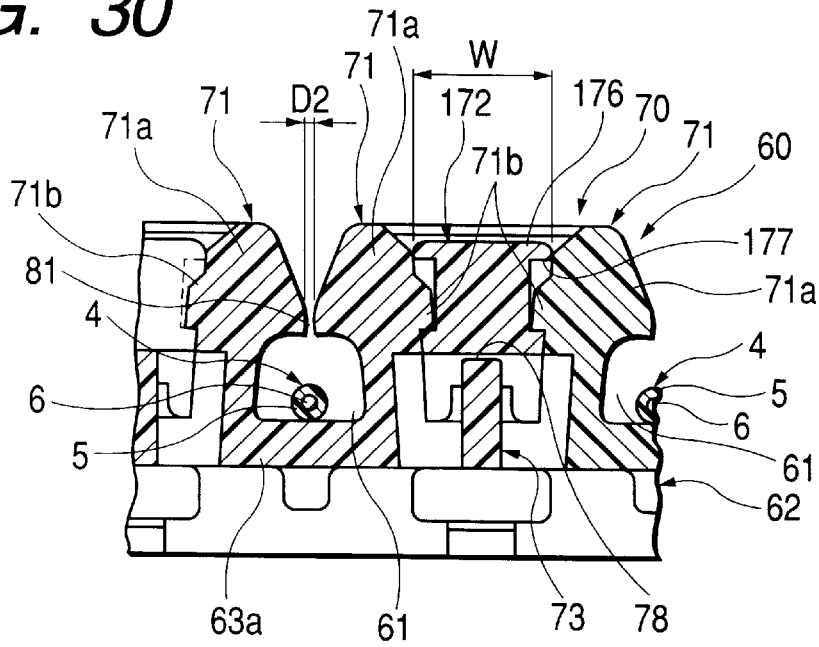
FIG. 30 is a sectional view along a line XXX—XXX in FIG. 28.

The deformation preventing projection 73 includes a restriction surface 78. As shown in FIG. 29, the restriction surface 78 opposes to the end surface 172*c* of the engagement member 172 which engages with the engagement projection 71*b*. The restriction surface 78 is formed a long the end surface 172*c*. The restriction surface 78 contacts to the end surface 172*c* of the engagement member 172 which engages with the engagement projection 71*b* or is positioned in the vicinity of the end surface 172*c*.

The withdrawal prevention wall 74 is provided between the adjacent wire receiving grooves 61. The withdrawal prevention wall 74 is provided along the width direction of the wire receiving groove 61 between the retaining pawls 71 disposed between the adjacent wire receiving grooves 61. As shown in FIGS. 24, 25, etc., the withdrawal prevention wall 74 is disposed so as to sandwich the deformation preventing projection 73 between the withdrawal prevention wall and engagement member 172 along the longitudinal direction of the wall 61. The withdrawal prevention wall 74 is formed integrally with the plate body 62 and extends upward from the bottom wall 63*a*.

A distance D (shown in FIG. 25) from the engagement projection 71*b* to the withdrawal prevention wall 74 is set such a value that the square portion 176 does not disengage from the engagement projection 71*b* even if the square portion 176 being engaged with the engagement projection 71*b* contacts to the withdrawal prevention wall.

The through hole 75 is provided between the adjacent wire receiving grooves 61. The through hole 75 is provided along the width direction of the wire receiving groove 61 between the retaining pawls 71 extended upward from the edges of the adjacent wire receiving grooves 61. As shown in FIG. 25, the through hole 75 is disposed so as t sandwich the deformation preventing projection 73 between the through hole and the withdrawal prevention wall 74 along the longitudinal direction of the wire receiving groove 61. The through hole 75 is provided along the longitudinal direction of the wire receiving groove 61 between the near side wall 69 and the deformation preventing projection 73. The through hole 75 passes through the bottom wall 63*a* of the plate body 62.

In the wire fixing portion 70 configured in the aforesaid manner, the engagement member 172 engages with the engagement projection 71*b* to thereby restrict that the pawl body 71*a* of the retaining pawl 71 displaces toward the allowable position from the restriction position. The wire fixing portion 70 prevents the electric wire 4 received within the wire receiving groove 61 from withdrawing from the groove.

The press-connecting plate 60 is provided with a plurality of stop projections 66 and a plurality of not-shown stop receiving projections. These stop projections 66 and the stop receiving projections engage to each other. These stop projections 66 and the stop receiving projections engage to each other. At the time of constructing the aforesaid stacked plate connector 1, these stop projections 66 and the stop receiving projections engage to each other to thereby fix the press-connecting plates 60 to each other.

The press-connecting plate 60 is configured so as to arrange the JB press-connecting terminals 50 on the bottom wall 63*a* in the longitudinal direction of the groove bodies 61*a* of the wire receiving grooves 61 and in the direction along which the wire receiving grooves 61 are disposed in parallel. That is, the press-connecting plate 60 is configured so as to arrange the JB press-connecting terminals 50 in a two-dimensional matrix pattern on the bottom wall 63*a*.

At the time of assembling the stacked plate connector 1, first, the JB press-connecting terminals 50 are mounted on the press-connecting plate 60. In this case, the JB press-connecting terminal 50 is brought close to the bottom wall 63*a* and attached to the plate body 62. The stop piece 58 engages with the inner surface of the separation wall 63*b*, then the JB press-connecting terminal 50 is received within the wire receiving groove 61 and fixed to the press-connecting plate 60.

Then, the electric wire 4 is press-connected to the JB press-connecting terminal 50 which is received within the body 61 and the receiving portion 64. In this case, the electric wire 4 is inserted with pressure between the press-connecting blades 54*a*, 54*b* of the wire connection portion 51 and also inserted within the wire receiving groove 61. At the time of inserting the electric wire 4 within the grove 61, the electric wire 4 is inserted with pressure between the retaining pawls 71 provided at the both edges of the wire receiving groove 61 of the wire fixing portion 70.

Figure 31A:
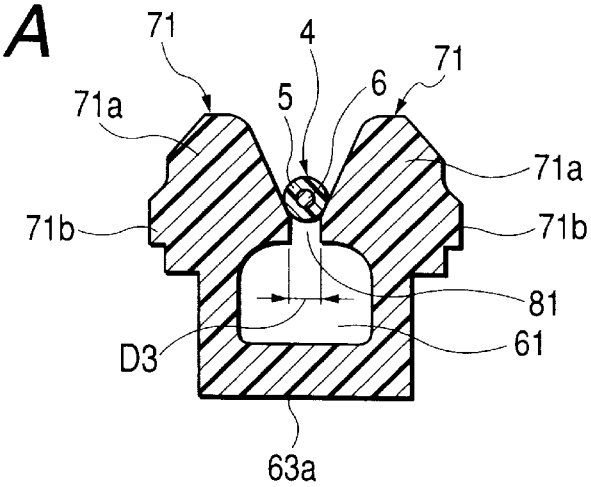
FIGS. 31A to 31C are sectional views illustrating a process of inserting with pressure an electric wire within the wire receiving groove of the press-connecting plate.
Figure 31B:
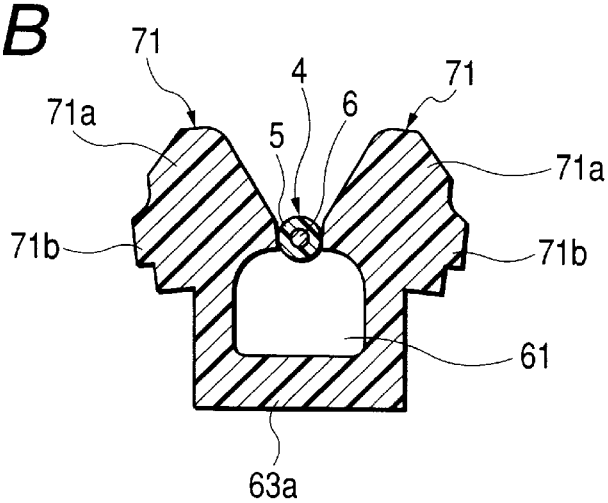

In this case, first, the electric wire 4 abuts against the pawl bodies 71*a* of the retaining pawls 71 as shown in FIG. 31A. When the electric wire 4 is further inserted with pressure between the pawl bodies 71*a*, the retaining pawls 71 displace to the allowable position against the elastic restoring force as shown in FIG. 31B.

Figure 31C:
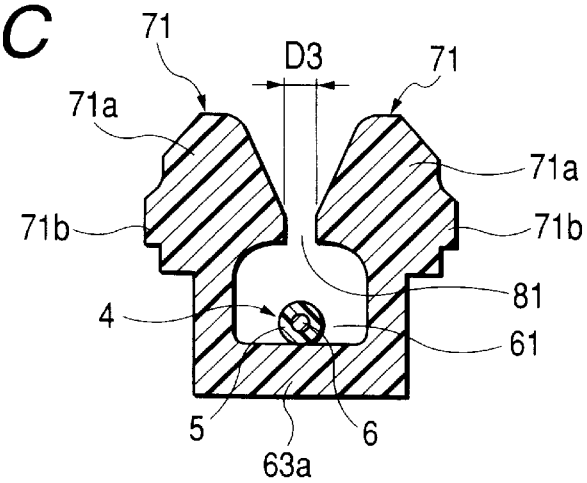

When the electric wire 4 is furthermore inserted with pressure within the wire receiving groove 61, the electric wire 4 is placed on the bottom wall 63*a*. Then, the retaining pawls 71 displace to the restriction position by the elastic restoring force as shown in FIG. 31C. The electric wire 4 is prevented from withdrawing from the wire receiving groove 61 by the retaining pawls 71.

Then, the engagement member 172 of the wire fixing portion 70 is engaged with the engagement projections 71*b* of the retaining pawls 71. Thus, since the width W is set to be larger than the distance D1, the gap 81 between the pair of the retaining pawls 71 extended upward from the both edges of the wire receiving groove becomes narrower. A distance D2 (shown in FIGS. 28 and 30) between the retaining pawls 71 with which the engagement member 172 engages becomes narrower than a distance D3 (shown in FIGS. 24 and 26) between the pair of the retaining pawls 71 extended upward from the both edges of the wire receiving groove 61.

In this manner, the engagement member 172 is elastically deformed against the elastic restoring force and engages with the engagement projections 71*b* as shown in FIGS. 28, 29, 31A, 31B, 31C, etc. When the engagement member 172 engages with the engagement projections 71*b*, the end surface 172*c* opposes to the restriction surface 78 of the deformation preventing projection 73 as shown in FIG. 29.

In this manner, the member 71 engages with the engagement projection 71*b* and the wire fixing portion 70 fixes the electric wire 4 so as not to withdraw from the wire receiving groove 61.

In this state, as shown in FIG. 2, the press-connecting plates 60 are stacked in a manner that the plate bodies 62 are in parallel from one another and with a space therebetween. Then, the press-connecting plates 60 are made close and fixed to each other by engaging the stop projections 66 and the stop receiving projections to each other. In the press-connecting plates 60, the connection bar 80 is inserted into the predetermined holes and the cylindrical hole of the potions 52 to thereby configure the stacked plate connector 1 as shown in FIG. 3.

The stacked plate connector 1 is arranged in a manner that the electric wires 4 to be press-connected to the JB press-connecting terminals 50 are connected in accordance with the predetermined pattern by selecting the positions where the JB press-connecting terminals 50 are arranged on the bottom wall 63*a* and the positions where the bars 80 are inserted. The stacked plate connector 1 is received within an electric coupling box, for example, in which relays, fuses, etc., are attached to thereby connect the electric wires 4, the aforesaid relays, fuses, etc., in accordance with a predetermined pattern.

According to the second embodiment, since the width W is larger than the distance D1, when the engagement member 172 is engaged between the retaining pawls 71 extended upward from the edges of the adjacent wire receiving grooves 61, the gap 81 between the pair of the retaining pawls 71 extended upward from the both edges of the wire receiving groove 61 becomes narrower.

Thus, when a relatively thin electric wire 4 is received within the wire receiving groove 61, the electric wire 4 likely contacts to the retaining pawls 71 even if the electric wire is forced to withdraw from the groove, so that such a phenomenon can be prevented from occurring that the electric wire 4 comes out through the gap 81 between the retaining pawls 71. Thus, an electric wire 4 can be surely fixed within the wire receiving groove 61 even if the thickness thereof is relatively thin.

Figure 32:
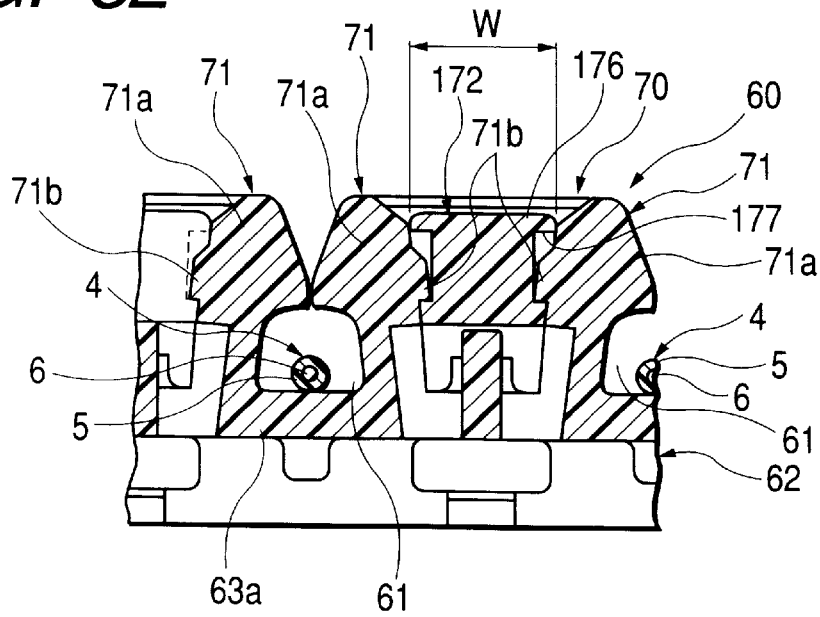
FIG. 32 is a sectional view showing a modified example of the wire fixing portion shown in FIG. 30.

Further, in the second embodiment, when the engagement member 172 is engaged between the retaining pawls 71, the gap 81 between the retaining pawls 71 extended upward from the both edges of the wire receiving groove 61 becomes narrower. However, the present invention may be arranged in a manner that when the engagement member 172 is engaged between the retaining pawls 71, the retaining pawls 71 extended upward from the both edges of the wire receiving groove 61 are made contact to each other as shown in FIG. 32.

In this case, the gap 81 between the pair of the retaining pawls 71 extended upward from the both edges of the wire receiving groove 61 becomes zero. Thus, even if the electric wire 4 with any thickness is received within the wire receiving groove 61, the electric wire surely contacts to the retaining pawls 71 when the electric wire 4 is forced to withdraw from the groove. Therefore, the electric wire can be prevented from withdrawing from the portion between the retaining pawls. Accordingly, the electric wire 4 with any thickness can be surely received within the wire receiving groove 61.

As described above, according to the second embodiment, when the engagement member engages between the retaining pawls extended upward from the adjacent wire receiving grooves, the distance between the pair of retaining pawls extended upward from the both edges of the wire receiving groove becomes smaller than the distance at the restriction position. Thus, when a relatively thin electric wire is received within the wire receiving groove, the electric wire likely contacts to the retaining pawls even if the electric wire is forced to withdraw from the groove, so that such a phenomenon can be prevented from occurring that the electric wire comes out the portion between the retaining pawls. Therefore, an electric wire can be surely fixed within the wire receiving groove even if the thickness thereof is relatively thin.

According to the second embodiment, the width of the engagement member along a width direction of the wire receiving groove is larger than the distance between the retaining pawls extended upward from the edges of the adjacent wire receiving grooves. Thus, when the engagement member engages between the retaining pawls extended upward from the edges of the adjacent wire receiving grooves, the gap between the pair of the retaining pawls extended upward from the both edges of the wire receiving groove becomes narrower more surely. Thus, such a phenomenon can be prevented more surely from occurring that the electric wire comes out the portion between the retaining pawls. Further, an electric wire can be more surely fixed within the wire receiving groove even if the thickness thereof is relatively thin.

According to the second embodiment, when the engagement member contacts between the retaining pawls disposed at the adjacent electric wires, the pair of the retaining pawls extended upward from the both edges of the wire receiving groove contact to each other. Thus, there appears no gap between the pair of the retaining pawls. Therefore, when a relatively thin electric wire is received within the wire receiving groove, the electric wire contacts to the retaining pawls even if the electric wire is forced to withdraw from the groove, so that such a phenomenon can be prevented from occurring that the electric wire comes out the portion between the retaining pawls. Therefore, an electric wire can be surely fixed within the wire receiving groove even if the thickness thereof is relatively thin.

It is contemplated that numerous modifications may be made to the plate-like insulating member and the method of fixing an electric wire to a plate-like insulating member, of the present invention without departing from the spirit and scope of the invention as defined in the following claims.

What is claimed is:

1. A plate-like insulating member, comprising:

a plurality of wire receiving grooves, in which electric wires are respectively receivable, juxtaposed to each other, the electric wires being respectively connectable to a plurality of press-connecting terminals; and a plurality of wire fixing portions which prevent the electric wires, received in the wire receiving grooves, from withdrawing from the wire receiving grooves, wherein the plurality of wire fixing portions include:

retaining pawls comprising:

pawl bodies which are disposed correspondingly to the wire receiving grooves to retain the electric wires in the respective wire receiving grooves, wherein each of the pawl bodies can displace between a restriction position in which the electric wire is prevented from withdrawing from the wire receiving groove, and an allowable position in which the electric wire is allowed to withdraw from the wire receiving groove, and engagement projections which protrude from the pawl bodies in a direction in which the pawl bodies respectively disposed in the adjacent wire receiving grooves approach each other, and at least one engagement member insertable between the pawl bodies disposed in the adjacent wire receiving grooves, the at least one engagement member being engaged with the engagement projections of the pawl bodies, thereby restricting displacement of the pawl bodies from the restriction position toward the allowable position.

2. The plate-like insulating member of claim 1, wherein the plurality of press-connecting terminals include wire connection portions, to which the electric wires are respectively connected, and electrical contact portions respectively extending from the wire connection portions.

3. The plate-like insulating member of claim 1, wherein each of the pawl bodies is elastically deformable between the restriction position and the allowable position, and is positioned at the restriction position in an initial state, and the at least one engagement member is elastically deformable and engages with the engagement projections against an elastic restoring force.

4. The plate-like insulating member of claim 3, further comprising:

a plate body made of insulative synthetic resin, the plate body being integrally formed with the retaining pawls and the at least one engagement member, wherein the retaining pawls are respectively provided at end portions of the wire receiving grooves.

5. The plate-like insulating member of claim 4, wherein the at least one engagement member is integrally formed at one end portion thereof with the plate body and can engage with the engagement projections of the pawl bodies at the other end portion of the at least one engagement member, and wherein the plate-like insulating member further comprises:

a deformation preventing projection protruding from the plate body and having a restriction surface which opposes the other end portion of the at least one engagement member engaging with the engagement projections.

6. The plate-like insulating member of claim 5, wherein the other end portion of the at least one engagement member engaging with the engagement projections is restricted from separating from the restriction surface of the deformation preventing projection.

7. The plate-like insulating member of claim 6, further comprising:

a withdrawal prevention wall extending upward from an end portion of the plate body, the withdrawal prevention wall being provided between the pawl bodies disposed in the adjacent wire receiving grooves, wherein the other end portion of the at least one engagement member engaging with the engagement projections can be displaced in a direction approaching the withdrawal prevention wall along the restriction surface of the deformation preventing projection.

8. The plate-like insulating member of claim 7, further comprising:

a convex-shaped curved surface formed at the other end portion of the at least one engagement member in a direction away from the plate body; and an outer wall extending upward from the end portion of the plate body, wherein the at least one engagement member is disposed between the outer wall and the withdrawal prevention wall.

9. The plate-like insulating member of claim 1, further comprising:

a plate body made of insulative synthetic resin, the plate body being integrally formed with the retaining pawls and the at least one engagement member, wherein the retaining pawls are respectively provided at end portions of the wire receiving grooves.

10. The plate-like insulating member of claim 9, wherein the at least one engagement member is integrally formed at one end portion thereof with the plate body and can engage with the engagement projections of the pawl bodies at the other end portion of the at least one engagement member, and wherein the plate-like insulating member further comprises:

a deformation preventing projection protruding from the plate body and having a restriction surface which opposes the other end portion of the at least one engagement member engaging with the engagement projections.

11. The plate-like insulating member of claim 10, wherein the other end portion of the at least one engagement member engaging with the engagement projections is restricted from separating from the restriction surface of the deformation preventing projection.

12. The plate-like insulating member of claim 11, further comprising:

a withdrawal prevention wall extending upward from an end portion of the plate body, the withdrawal prevention wall being provided between the pawl bodies disposed in the adjacent wire receiving grooves, wherein the other end portion of the at least one engagement member engaging with the engagement projections can displace in a direction approaching the withdrawal prevention wall along the restriction surface of the deformation preventing projection.

13. The plate-like insulating member of claim 12, further comprising:

a convex-shaped curved surface formed at the other end portion of the at least one engagement member in a direction away from the plate body; and an outer wall extending upward from the end portion of the plate body, wherein the at least one engagement member is disposed between the outer wall and the withdrawal prevention wall.

14. A method of fixing an electric wire to a plate-like insulating member, comprising the steps of:

providing a plate-like insulating member which comprises:

a plate body made of insulative synthetic resin;

a plurality of wire receiving grooves, in which electric wires are respectively receivable, juxtaposed to each other, the electric wires being respectively connectable to a plurality of press-connecting terminals;

a plurality of wire fixing portions which prevent the electric, wires, received in the wire receiving grooves, from withdrawing from the wire receiving grooves, wherein the plurality of wire fixing portions include:

retaining pawls integrally formed with the plate body at end portions of the wire receiving grooves, the retaining pawls comprising:

pawl bodies which are disposed correspondingly to the wire receiving grooves to retain the electric wires in the respective wire receiving grooves, wherein each of the pawl bodies can displace between a restriction position in which the electric wire is prevented from withdrawing from the wire receiving groove, and an allowable position in which the electric wire is allowed to withdraw from the wire receiving groove, and engagement projections which protrude from the pawl bodies in a direction in which the pawl bodies respectively disposed in the adjacent wire receiving grooves approach to each other, and at least one engagement member insertable between the pawl bodies disposed in the adjacent wire receiving grooves, the at least one engagement member being integrally formed with the plate body, the at least one engagement member being engaged with the engagement projections of the pawl bodies, thereby restricting displacement of the pawl bodies from the restriction position toward the allowable position; and an outer wall extending upward from an end portion of the plate body;

receiving an electric wire in one of the wire receiving grooves;

gradually inserting a pressing jig from a tip end thereof between the pawl bodies disposed at the adjacent wire receiving grooves and also between the engagement member and the outer wall, wherein thickness of the pressing jig becomes thinner toward the plate body; and engaging the engagement member with the engagement projections.

15. The method of claim 14, wherein the plate body has through holes each provided at a portion which is between the pawl bodies disposed at the adjacent wire receiving grooves and also between the engagement member and the outer wall, and wherein, in the step of gradually inserting the pressing jig, a pushing jig having a pushing surface along one end portion of the engagement member is inserted through the through hole from a reverse side of the pushing jig from the pressing surface into the portion which is between the pawl bodies and also between the at least one engagement member and the outer wall.

16. A plate-like insulating member, comprising:

a plurality of wire receiving grooves, in which electric wires are respectively receivable, juxtaposed to each other, each of the wire receiving grooves having a distance along a width direction thereof, the electric wires being respectively connectable to a plurality of press-connecting terminals; and a plurality of wire fixing portions which prevent the electric wires, received in the wire receiving grooves, from withdrawing from the wire receiving grooves, wherein the plurality of wire fixing portions include:

pairs of retaining pawls extended upward from respective opposite edges of the wire receiving grooves in the width directions thereof to retain the electric wires in the wire receiving grooves, wherein each of the retaining pawls can displace between a restriction position in which the electric wire is prevented from withdrawing from the wire receiving groove, and an allowable position in which the electric wire is allowed to withdraw from the wire receiving groove, and at least one engagement member insertable between the retaining pawls disposed in the adjacent wire receiving grooves to engage with the retaining pawls, thereby restricting displacement of the pawl bodies toward the allowable position and causing a distance between the pair of retaining pawls extended upward from the opposite edges of the wire receiving groove to become smaller than a distance between the pair of retaining pawls at the restriction position.

17. The plate-like insulating member of claim 16, wherein the plurality of press-connecting terminals include wire connection portions, to which the electric wires are respectively connected, and a plurality of electrical contact portions respectively extending from the wire connection portions.

18. The plate-like insulating member of claim 16, wherein a width of the at least one engagement member along the width direction of the wire receiving groove is greater than a distance between the retaining pawls extended upward from the edges of the adjacent wire receiving grooves at the restriction position.

19. The plate-like insulating member of claim 18, wherein when the at least one engagement member is engaged between the retaining pawls, the pair of retaining pawls extended upward from the opposite edges of the wire receiving groove are brought into contact with each other.

20. The plate-like insulating member of claim 16, wherein when the at least one engagement member is engaged between the retaining pawls, the pair of retaining pawls extended upward from the opposite edges of the wire receiving groove are brought into contact with each other.

* * * * *